US008302451B2

(12) United States Patent
Matsuo et al.

(10) Patent No.: US 8,302,451 B2
(45) Date of Patent: Nov. 6, 2012

(54) CAN MANUFACTURING DEVICE AND CAN MANUFACTURING METHOD

(75) Inventors: Syouji Matsuo, Nagaoka (JP); Kenji Fujimoto, Nagaoka (JP); Masahiro Hosoi, Gotemba (JP)

(73) Assignee: Mitsubishi Materials Corporation, Tokyo (JP)

( * ) Notice: Subject to any disclaimer, the term of this patent is extended or adjusted under 35 U.S.C. 154(b) by 667 days.

(21) Appl. No.: 12/449,978

(22) PCT Filed: Mar. 10, 2008

(86) PCT No.: PCT/JP2008/054286

§ 371 (c)(1),
(2), (4) Date: Sep. 4, 2009

(87) PCT Pub. No.: WO2008/111552

PCT Pub. Date: Sep. 18, 2008

(65) Prior Publication Data

US 2010/0092266 A1 Apr. 15, 2010

(30) Foreign Application Priority Data

Mar. 9, 2007 (JP) ..... 2007-060384
Sep. 26, 2007 (JP) ..... 2007-249719

(51) Int. Cl.
*B21D 26/00* (2006.01)
*H02K 41/03* (2006.01)
*B30B 1/42* (2006.01)
*B30B 1/10* (2006.01)

(52) U.S. Cl. ..... 72/430; 72/447; 72/707; 29/419.2; 83/630; 100/43

(58) Field of Classification Search ..... 72/379.4, 72/414, 430, 447, 451, 707; 29/419.2; 83/630; 100/43

See application file for complete search history.

(56) References Cited

U.S. PATENT DOCUMENTS

| | | | | |
|---|---|---|---|---|
| 3,599,462 | A * | 8/1971 | Kline et al. | 29/419.2 |
| 6,206,683 | B1 | 3/2001 | Takahashi et al. | |
| 7,024,912 | B2 * | 4/2006 | Campo et al. | 72/414 |
| 7,398,665 | B2 * | 7/2008 | Campo et al. | 72/379.4 |
| 7,523,699 | B2 * | 4/2009 | Sakamoto | 72/451 |
| 7,752,880 | B2 * | 7/2010 | Sakamoto | 72/430 |

FOREIGN PATENT DOCUMENTS

| | | | |
|---|---|---|---|
| JP | 11-239897 | A | 9/1999 |
| JP | 2002-336999 | A | 11/2002 |
| JP | 2003-251424 | A | 9/2003 |
| JP | 2004-223606 | A | 8/2004 |
| JP | 2005-329423 | A | 12/2005 |
| JP | 2005-329424 | A | 12/2005 |

OTHER PUBLICATIONS

International Search Report mailed May 1, 2008, issued on PCT/JP2008/054286.

* cited by examiner

*Primary Examiner* — David B Jones
(74) *Attorney, Agent, or Firm* — Edwards Wildman Palmer LLP

(57) ABSTRACT

A can manufacturing device in which a tool supporting base has: a plurality of working tool units that support a plurality of working tools; a supporting member that supports a plurality of working tool units; and a linear driving mechanism that reciprocates the working tool units with respect to the supporting member in the axial direction of a workpiece. The linear driving mechanism has: a guide section that is fixed on the supporting member with a base plate therebetween; a slide rail that is fixed on the working tool unit and slides along the guide section; an electromagnetic coil provided on the base plate; a magnet plate that is provided on the working tool unit and generates, between the electromagnetic coil and itself, a thrust force for the guide section; and a supply pipe that is provided at the electromagnetic coil and supplies coolant to the inside of the electromagnetic coil.

18 Claims, 22 Drawing Sheets

CAN MANUFACTURING DEVICE AND CAN MANUFACTURING METHOD

TECHNICAL FIELD

The present invention relates to a can manufacturing device for manufacturing, for example, metal cans for beverages, in particular, bottle-shaped cans, and a can manufacturing method that uses this device.

Priority is claimed on Japanese Patent Application No. 2007-060384, filed Mar. 9, 2007, and Japanese Patent Application No. 2007-249719, filed Sep. 26, 2007, the contents of which are incorporated herein by reference.

BACKGROUND ART

As an example of a bottle can manufacturing device according to a first conventional technique for manufacturing a bottle-shaped metal can (hereunder, referred to simply as a bottle can), a bottle can manufacturing device disclosed in Patent Document 1 has been known. This bottle can manufacturing device is provided with a workpiece supporting disk that supports a bottom-ended cylindrical workpiece and a tool supporting disk that supports a plurality of working tools for performing working on the workpiece, arranged facing each other, in which these workpiece supporting disk and the tool supporting disk are made to approach and move away from each other by a driving device using a crank mechanism to thereby perform working on the workpiece supported on the workpiece supporting disk. The plurality of working tools are arranged so as to correspond to the order of workings to be performed on the workpiece. Moreover, the workpiece is moved to a position where the next working tool performs working upon each single stroke in which both of the supporting disks approach and move away from each other. The stroke of the supporting disks and the movement of the workpiece are repeated to thereby sequentially perform workings on the workpiece, and at the point of time where a series of workings are completed, a bottle can having a predetermined shape is manufactured.

Moreover, there is a bottle can manufacturing device according to the first conventional technique in which a workpiece supporting disk and a tool supporting disk are respectively individually driven, rather than being synchronous-driven with use of the crank mechanism as described above (for example, refer to Patent Document 2).

Patent Document 2 discloses a structure in which on the inner side of the tool supporting disk there is provided a primary shaft extending in the axial direction of a workpiece, and a plurality of tool supporting disks arranged in the circumferential direction that respectively take a share of a plurality of working tools (this is referred to as a working tool unit) are slidably joined and supported on the primary shaft.

[Patent Document 1] Japanese Unexamined Patent Application, First Publication No. 2005-329424

[Patent Document 2] Japanese Unexamined Patent Application, First Publication No. 2002-336999

As a second conventional technique, there is an aluminum bottle can for beverages in which the shoulder section thereof is formed in a smooth tapered shape, the opening section thereof is drawn slimmer than the body section, screw working is performed on the outer periphery of the drawn opening section, and after filling with contents, the opening section thereof is sealed with a cap made from a material such as aluminum.

As a device for manufacturing such a bottle can, a manufacturing device disclosed in Patent Documents 3 and 4 is known, for example.

This device is configured with a disk-shaped turntable that supports a plurality of chuck units that hold bottom-ended cylindrical workpieces and that are capable of intermittently rotating about the rotational axis, and a disk-shaped die table that supports a plurality of working tools for performing working on the workpieces and that are arranged facing the turntable in the rotational axial direction, and a driving device that uses a crank mechanism makes the die table approach and move away from the turntable to thereby perform working on the workpiece arranged between the tables.

The plurality of working tools are arranged so as to correspond to the order of workings to be performed on the workpiece. Moreover, the workpiece is moved to a position where the next working tool performs working upon each single stroke in which the tables approach and move away from each other. The stroke of the tables and the movement of the workpiece are repeated to thereby sequentially perform workings on the workpiece, and at the point of time where a series of workings are completed, a bottle can having a predetermined shape is completed. As described above, to have a bottle can completed, workings are performed through a number of steps. In particular, in a case where the diameter difference between the body section and the opening section of the can is significant, the diameter needs to be reduced in a phased manner, and the number of steps tends to become large. The manufacturing process includes more than forty steps in total, including the steps of: lubricant application step, necking performed on the region from the workpiece shoulder section to the opening section; and various types of rotation workings such as trimming for making uniform the opening end section, expanding for partially expanding the opening, threading for forming a screw thread in the opening section, curling for curling the opening end section, and throttle working to press the curled section.

[Patent Document 3] Japanese Unexamined Patent Application, First Publication No. 2003-251424

[Patent Document 4] Japanese Unexamined Patent Application, First Publication No. 2005-329423

DISCLOSURE OF INVENTION

Problems to be Solved by the Invention

However, in the bottle can manufacturing device according to the above first conventional technique, there is the following problem.

That is to say, there is a problem in that the working tool supported on the tool supporting disk (working tool unit) needs to coaxially perform working on the workpiece held on the workpiece supporting disk in close proximity, and consequently, if working is performed in a state with the central axis of the working tool deviated from the center axis of the workpiece, the product quality of the formed bottle can will be reduced. That is to say, there is a problem in that in order to prevent deformation in the working tool unit when reciprocating, or prevent the axis from being deviated with respect to the workpiece, the working tool unit and the primary shaft need to have a rigid structure, and consequently the weight of these members increases as the size of them increases, causing the bottle can manufacturing device to become large in size.

Moreover, in the bottle can manufacturing device according to the above second conventional technique, the structure is such that the driving force of the driving device is transmitted via a gear to the rotational shaft, and the crank mechanism arranged on the rotational shaft linearly reciprocates the joining shaft that supports the die table. Thus, the chuck unit and the working tools are made to approach and move away from each other in the rotational axial direction, to thereby perform working on the workpiece arranged therebetween. Moreover, in the manufacturing steps, the time required for working is different between the working tools, and the time setting for a single stroke is set long to suit the various types of rotational workings (threading, curling, and the like) that are particularly time consuming.

In the above driving mechanism, in a case where the rotational shaft of the crank is rotated at a high speed and thereby the reciprocation speed is raised, the period of time for the various types of rotational working tools to remain in the proximity of the bottom dead point where they can perform working on the workpiece, is reduced, and it consequently becomes impossible to perform excellent working. Therefore, the speed cannot be raised to exceed a certain speed, and this is a factor that has been preventing improvement in the production efficiency of the bottle can manufacturing device. Moreover, in order to transmit the driving force of the driving device to the die table, a number of transmission members are engaged with each other to operate as described above, and this not only makes the device significantly large but also increases the mechanical load (frictional loss or the like) on the members, consequently requiring high power for reciprocating the die table.

The present invention takes the above problems into consideration, and a first object thereof is to provide a can manufacturing device in which members are made small to thereby reduce the weight thereof, and damage or breakage in a supply pipe for supplying coolant to the electromagnetic coil can be prevented.

Moreover, a second object of the present invention is to provide a can manufacturing device and a can manufacturing method in which the configuration of the driving mechanism is simplified and shape-formation of cans can be performed at an excellent level of precision over a prolonged period of time, while a single stroke time can be reduced and production efficiency can be significantly improved.

Furthermore, a third object of the present invention is to provide a can manufacturing device and a can manufacturing method that uses this device, in which vibrations in the working tool unit are suppressed and thereby precision of workings to be performed on cans is improved.

Means for Solving the Problem

A can manufacturing device according to a first aspect of the present invention is a can manufacturing device provided with: a workpiece supporting base that supports, on a circumference thereof, a plurality of bottom-ended cylindrical workpieces having an axis; and a tool supporting base that supports a plurality of working tools for performing working on the workpieces and that is arranged facing the workpiece supporting base in the axial direction of the workpiece, in which the plurality of working tools are made to approach and move away from the workpiece supporting base in the axial direction of the workpieces, to thereby perform working on the workpieces supported on the workpiece supporting base, wherein the tool supporting base is provided with: a plurality of working tool units that support the plurality of working tools; a supporting member that supports the plurality of working tool units; and a linear driving mechanism that reciprocates the working tool units with respect to the supporting member in the axial direction of the workpiece, and the linear driving mechanism is provided with: a guide section that is fixed on the supporting member with a base plate therebetween; a slide rail that is fixed on the working tool unit and that slides along the guide section; an electromagnetic coil provided on the base plate; a magnet plate that is provided on the working tool unit and that generates, between the electromagnetic coil and itself, a thrust force for the guide section; and a supply pipe that is provided at the electromagnetic coil and that supplies coolant to the inside of the electromagnetic coil.

According to the can manufacturing device according to the first aspect of the present invention, the slide rail is fixed on the working tool unit and the working tool unit thereby has a reinforced structure. Consequently, it is possible to reduce the weight of the can manufacturing device by making the size of the members small, for example, by reducing the thickness of the base of the working tool unit. Therefore, when the working tool unit is reciprocated so as to approach and move away from the workpiece supporting base, deformation or distortion no longer occurs in the working tool unit, and problems such as displacement of the working tool with respect to the workpiece can be prevented while performing working at a high level of precision. In addition, since the weight of the working tool unit is reduced, the members of the supporting member can be made small.

Furthermore, since the electromagnetic coil is fixed on the base plate that is fixed, the supply pipe for supplying coolant to the electromagnetic coil will not move together with reciprocation of the working tool unit, and thereby damage or breakage of the supply pipe can be prevented.

It may be arranged such that the base plate is provided with an engaging member that engages with the slide rail to thereby stop the working tool unit.

In this case, the engaging member is fixed on the base plate, and hence it is possible to further reduce the weight of the working tool unit that reciprocates.

It may be arranged such that the working tool unit is provided with a base that is of a flat plate shape and that has the slide rail fixed on a back face of the base, and a tool holding section that is vertically provided on an edge of a surface of the base, the surface facing the workpiece supporting base, and that holds the working tool, and the base and the tool holding section are arranged substantially in a L shape from a side view.

In this case, since the working tools are arranged in a predetermined position and held by the tool holding section that is vertically provided on the base and the thickness of the base can be made thin, the weight of the working tool can be reduced.

It may be arranged such that the base plate is provided with a stopper that regulates a reciprocation terminus of the working tool.

In this case, if the reciprocating working tool unit is not stopped by an operation of a main brake, it is possible to bring a part of the working tool unit into contact with the stopper to thereby stop the working tool unit. In addition, the stopper is fixed on the base plate, and hence the weight of the working tool unit is not increased.

A bottle can manufacturing device according to a first configuration of a second aspect of the present invention is a bottle can manufacturing device provided with: first and second turntables that are arranged facing each other and that are capable of intermittently rotating about a rotational axis; a plurality of chuck units that are provided on an outer periphery section of the turntables and that hold a bottom-ended cylindrical workpiece; a linear motor frame arranged between the first and second turntables; a tool supporting body supported on the linear motor frame with a linear motor therebetween; and a plurality of working tools that are provided on the tool supporting body and are respectively arranged facing the first and second turntables and that perform working on the workpieces, wherein the plurality of working tools are linearly reciprocated, via the tool supporting base, between the first and second turntables by the linear motor, and when performing the linear reciprocation, the plurality of working tools are made to alternately approach and move away from the first and second turntables, to thereby perform working on the workpiece.

According to the can manufacturing device according to the first configuration of the second aspect of the present invention, the working tool is driven by the linear motor, and hence it is possible to freely adjust the speed of approaching and moving away during strokes. Therefore, it is possible to provide a long time for the working tool to remain in the proximity of the bottom dead point where the working tool comes closest to the chuck unit and working can be performed on the workpiece, and to increase the speed during the time of approaching or moving away when working is not performed. Moreover, the turntables are respectively arranged on the one side and the other side of the linear motor frame so as to face each other, and the working tools arranged facing the respective turntables are linearly reciprocated by the linear motor. Consequently, it is possible to perform working on the workpiece during both forward and backward movement in the reciprocation. Therefore, it is possible to significantly improve production efficiency compared to the conventional can manufacturing device.

It may be arranged such that the tool supporting body is further provided with first and second die tables that are arranged facing the first and second turntables in the rotational axial direction, respectively and that each support the plurality of working tools; and the first and second die tables are driven by the linear motor.

Moreover, it may be arranged such that: the tool supporting body is further provided with a plurality of die units that each support at least one of the plurality of working tools; the linear motor is provided at each of the die units; and the die units are driven by the respective linear motors to be thereby made to approach and move away from the first and second turntables.

In the above cases, one or more of the plurality of working tools are supported on the plurality of die units, and the die units are supported by the respective linear motors. Consequently, it is possible to have each of the die units approach and move away from the turntable in an individual pattern. Therefore, a normal speed linear motor can be used for the necking that takes a typical amount of working time per single stroke, and a high speed linear motor can be used for the various types of rotational workings that take a comparatively longer time, and it is thus possible to drive with a different linear motor for each die unit. As a result, it is possible to flexibly configure the device in accordance with the workings, and thereby economical and highly efficient production can be performed.

A can manufacturing device according to a second configuration of the second aspect of the present invention is a can manufacturing device provided with: first and second working tools that are arranged facing each other and that perform working on bottom-ended cylindrical workpieces; a linear motor frame arranged between the first and second working tools; a turntable supporting body supported, via a linear motor, by the linear motor frame; first and second turntables that are provided on the turntable supporting body and are arranged facing the first and second working tools, respectively, and that are capable of intermittently rotating about the rotational axis; and a plurality of chuck units that are provided on the outer periphery of the turntables and that hold the work, wherein the first and second turntables, via the turntable supporting body, are linearly reciprocated between the first and second working tools by the linear motor, and when performing the linear reciprocation, the first and second turntables are made to alternately approach and move away from the first and second working tools, respectively, to thereby perform working on the workpieces.

According to the can manufacturing device according to the second configuration of the second aspect of the present invention, the turntable that supports the chuck unit is driven by the linear motor, and hence it is possible to freely adjust the speed of approaching and moving away during strokes. Therefore, it is possible to provide a long time for the chuck unit to remain in the proximity of the bottom dead point where the chuck unit comes closest to the working tool and working can be performed on the workpiece, and to increase the speed during the time of approaching or moving away when working is not performed. Moreover, the working tools are respectively arranged on the one side and the other side of the linear motor frame so as to face each other, and the chuck units arranged facing the respective working tools are linearly reciprocated by the linear motor. Consequently, it is possible to perform working on the workpiece during both forward and backward movement in the reciprocation. Therefore, it is possible to significantly improve production efficiency compared to the conventional can manufacturing device.

A can manufacturing method according to a third configuration of the second aspect of the present invention is a can manufacturing method that uses the can manufacturing device according to the first configuration of the second aspect of the present invention, wherein: arranging the workpiece at each of the plurality of chucks to hold the workpiece; linearly reciprocating the plurality of working tools, via the tool supporting body, between the first and second turntables by the linear motor; and moving the plurality of working tools alternately closer to and away from the first and second turntables when performing the linear reciprocation, to thereby perform working on the workpiece.

A can manufacturing method according to a fourth configuration of the second aspect of the present invention is a can manufacturing method that uses the can manufacturing device according to the second configuration of the second aspect of the present invention, wherein: arranging the workpiece at each of the plurality of chucks to hold the workpiece; linearly reciprocating the first and second turntables, via the turntable supporting body, between the first and second working tools by the linear motor; and moving the first and second turntables alternately closer to and away from the first and second working tools when performing the linear reciprocation, to thereby perform working on the workpiece.

A can manufacturing device according to a first configuration of a third aspect of the present invention is a can manufacturing device provided with: a workpiece supporting base that supports, on a circumference thereof, a plurality of bottom-ended cylindrical workpieces having an axis; and a tool supporting base that supports a plurality of working tools for performing working on the workpieces and that is arranged facing the workpiece supporting base in the axial direction of the workpiece, in which the plurality of working tools are made to approach and move away from the workpiece supporting base in the axial direction of the workpieces, to thereby perform working on the workpieces supported on the workpiece supporting base, wherein the tool supporting base is provided with: a working tool unit that is made to approach and move away from the workpiece supporting base in the axial direction; and a supporting trestle that supports the working tool unit so as to be able to move in the axial direction, the working tool unit is provided with: a base that moves along the axial direction; and a tool supporting disk that is fixed on the workpiece supporting base side of the base and that has the working tool arranged thereon in the circumferential direction thereof, the base is provided with: a projecting section that extends along the axial direction; and a magnet plate provided on the outer side surface of the projecting section, the supporting trestle is provided with: a recessed groove section that engages with the projecting section so as to be able to relatively move in the axial direction; and an electromagnetic coil provided on the inner side surface of the recessed groove section, and wherein in a state where the projecting section is engaged with the recessed groove section, the electromagnetic coil and the magnet plate generate a thrust force to move the working tool unit in the axial direction.

Moreover, a can manufacturing device according to a second configuration of the third aspect of the present invention is a can manufacturing device provided with: a workpiece supporting base that supports, on the circumference thereof, a plurality of bottom-ended cylindrical workpieces having an axis; and a tool supporting base that supports a plurality of working tools for performing working on the workpieces and that is arranged facing the workpiece supporting base in the axial direction of the workpiece, in which the plurality of working tools are made to approach and move away from the workpiece supporting base in the axial direction of the workpieces, to thereby perform working on the workpieces supported on the workpiece supporting base, wherein the tool supporting base is provided with: a working tool unit that is made to approach and move away from the workpiece supporting base in the axial direction; and a supporting trestle that supports the working tool unit so as to be able to move in the axial direction, the working tool unit is provided with: a base that moves along the axial direction; and a tool supporting disk that is fixed on the workpiece supporting base side of the base and that has the working tool arranged thereon in the circumferential direction thereof, the base is provided with: a recessed groove section that extends along the axial direction; and a magnet plate provided on the inner side surface of the recessed groove section, the supporting trestle is provided with: a projecting section that engages with the recessed groove section so as to be able to relatively move in the axial direction; and an electromagnetic coil provided on the outer side surface of the projecting section, and wherein in a state where the recessed groove section is engaged with the projecting section, the magnet plate and the electromagnetic coil generate a thrust force to move the working tool unit in the axial direction.

Moreover, a can manufacturing method according to a third configuration of the third aspect of the present invention is a can manufacturing method that uses the can manufacturing device according to the first or the second configuration of the third aspect of the present invention, wherein: the workpiece supporting base supports the workpiece; and the plurality of working tools are made to approach and move away from the workpiece supporting base in the axial direction of the workpiece, to thereby perform working on the workpiece supported on the workpiece supporting base.

According to the above can manufacturing devices and can manufacturing method according to the third aspect of the present invention, a magnetic field is generated between the magnet plate and the electromagnetic coil positioned on both sides of the projecting section, and thereby the electromagnetic coil and the magnet plate are linearly relatively moved in the axial direction of the workpiece. Consequently, the working tool unit can be made to approach and move away from the workpiece supporting base, to thereby perform, with the working tool, working on the workpiece. Since the configuration forms a double-side type linear driving method in which the electromagnetic coil and the electromagnetic plate are provided respectively on both sides of the projecting section, compared to that of the single-side type linear driving method with the same thrust force, it is possible to reduce the magnetic attraction force to an approximately 1/10 level. Consequently, the load applied on the members that fix and support the electromagnetic coil and the magnetic plate becomes smaller, and the size and weight of the working tool unit can be reduced. Therefore, it is possible to suppress vibrations in the working tool unit when it reciprocates.

It may be arranged such that the working tool unit is arranged on an outer side or an upper side of the supporting trestle.

In this case, the working tool unit is supported from the inner side or underside by the supporting trestle, and there is no supporting frame on the outer side or upper side of the working tool unit. It is therefore possible to ensure a space for installation and maintenance of the working tools, and operation efficiency can be consequently improved.

It may be arranged such that the base is provided in plural numbers.

In this case, the tool supporting disk is supported by a plurality of the bases, and hence it is possible to employ a tool supporting disk with a large outer diameter. Consequently, it is possible to increase the number of the working tools to be arranged on the tool supporting disk.

Advantageous Effect of the Invention

According to the can manufacturing device according to the first aspect of the present invention, the slide rail is fixed on the working tool unit and the working tool unit consequently has a reinforced structure. Therefore, it is possible to reduce the size of the members of the working tool unit while maintaining the rigidity of the members, to thereby reduce the weight of the can manufacturing device. Moreover, since the size of the supporting member that supports the working tool unit can be made small, the weight of the bottle can manufacturing device can be further reduced.

Furthermore, since the electromagnetic coil is fixed on the base plate that is fixed, the supply pipe for supplying coolant to the electromagnetic coil will not move together with reciprocation of the working tool unit. As a result, damage or breakage of the supply pipe can be prevented.

According to the can manufacturing device and the can manufacturing method according to the second aspect of the present invention, the turntables are arranged respectively on the one side and the other side of the linear motor frame so as to face each other, and the working tools arranged so as to face the respective turntables can perform working on the workpiece respectively during both forward and backward movement in the reciprocation. Therefore, it is possible to significantly improve production efficiency compared to the conventional can manufacturing device. Moreover, due to linear motor driving, it is possible to freely configure time allocation for a single stroke of working.

According to the can manufacturing device according to the third aspect of the present invention and the can manufacturing method that uses this device, there is provided a configuration forming the double-side type linear driving method in which the electromagnetic coil and the electromagnetic plate are respectively provided on both sides of the projecting section. Therefore it is possible to make the magnetic attraction force smaller than that of the single-side type linear driving method with the same thrust force. Consequently, the load applied on the members that fix and support the electromagnetic coil and the magnetic plate becomes smaller, and hence the size and weight of the working tool unit can be reduced. Therefore, it is possible to suppress vibrations in the working tool unit when it reciprocates, and consequently it is possible to prevent problems such as displacement of the working tool with respect to the workpiece, prevent defective working on the bottle cans, and thereby improve working precision.

DESCRIPTION OF THE REFERENCE SYMBOLS

Figure 1:
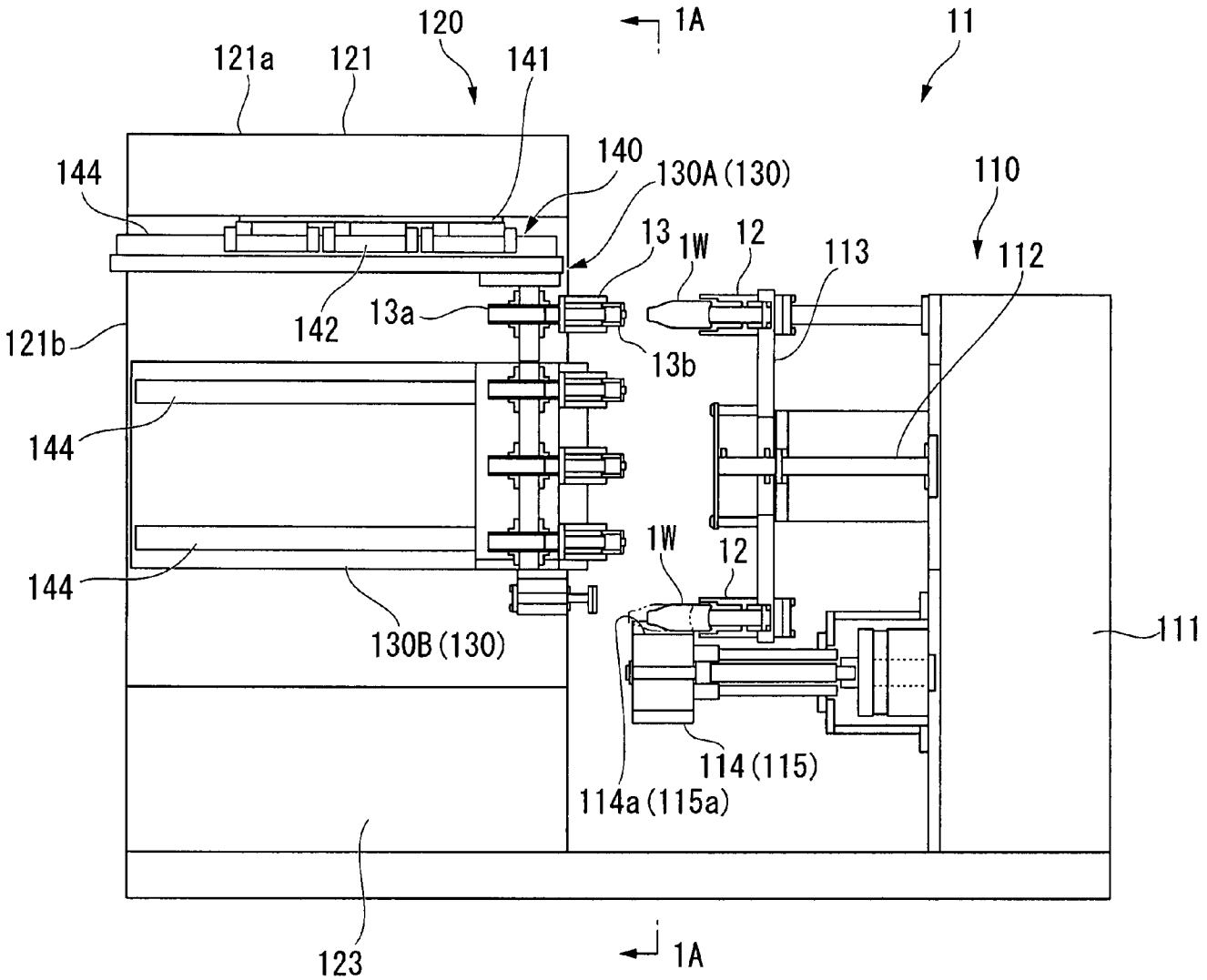
FIG. 1 is a side view showing a schematic configuration of a bottle can manufacturing device according to a first embodiment of the present invention.

11 Bottle can manufacturing device
13 Working tool
110 Workpiece supporting base
113 Workpiece supporting disk
120 Tool supporting base
121 Outer supporting frame (supporting member)
130, 130A, 130B, 130C Working tool unit
131 Base
140 Linear driving mechanism
141 Base plate
142 Guide section
143 Electromagnetic coil
144 Slide rail
145 Magnet plate
146 Clamp section (engaging member)
148 Stopper
1W Workpiece
210A Bottle can manufacturing device according to the second embodiment of the present invention
210B Bottle can manufacturing device according to the modified example of the second embodiment of the present invention
22 Linear motor frame
24*a*, 24*b* Turntable
25*a*, 25*b* Chuck unit
26*a*, 26*b* Die table
27*a*, 27*b* Working tool
211 Linear motor
212*a*, 212*b* Die unit
215 Linear motor
C1 Turntable rotation axis
2F Linear motor reciprocation linear motion direction
2Wa, 2Wb Workpiece
31 Bottle can manufacturing device (can manufacturing device)
32 Workpiece holder
33 Working tool
310 Workpiece supporting base
313 Workpiece supporting disk
320 Tool supporting base
321 Fixed section
330 Working tool unit
331, 331A to 331D T-shape base (base)
332 Tool supporting disk
334 Projecting section (projecting section)
335 Recessed base
335*a* Recessed groove section
340 Linear driving mechanism
341 Supporting trestle
341*a* Recessed groove section
341*c* Projecting section (projecting section)
342 Guide section
343, 343A, 343B Electromagnetic coil
344 Slide rail
345, 345A, 345B Magnet plate

346 Supporting trestle
346*a* Recessed groove section
3W Workpiece

BEST MODE FOR CARRYING OUT THE INVENTION

A bottle manufacturing device according to embodiments of the present invention will be described below. Hereunder, a bottle can is taken as an example in the description. However, the present invention can also be applied to manufacturing of cans other than a bottle can. Moreover, the bottle can here refers to a bottle shaped can as described above.

First Embodiment

Figure 2:
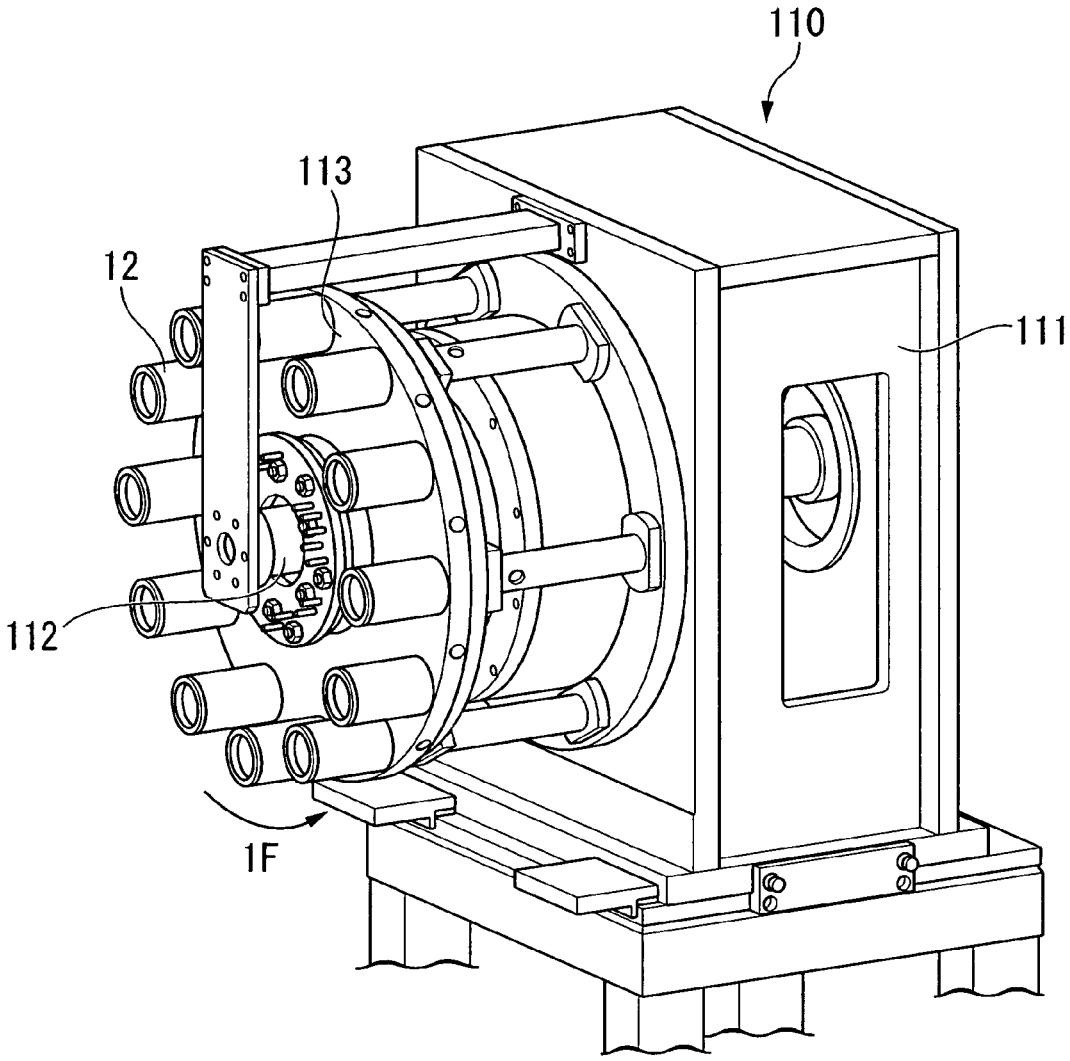
FIG. 2 is a perspective view showing a schematic configuration of a workpiece supporting base.
Figure 3:
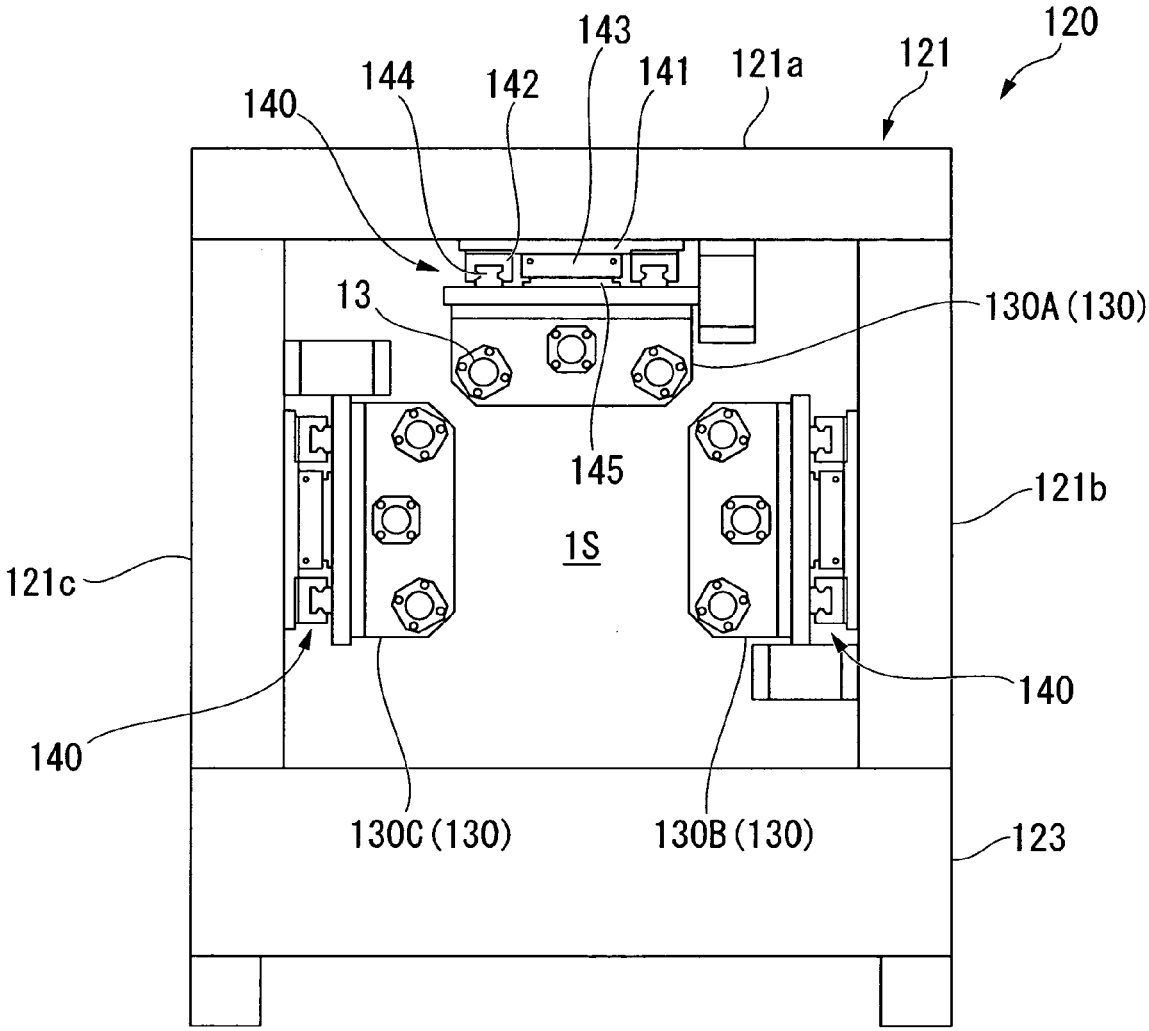
FIG. 3 is a fragmentary view showing the tool supporting base shown in FIG. 1, taken along the line 1A-1A.
Figure 4:
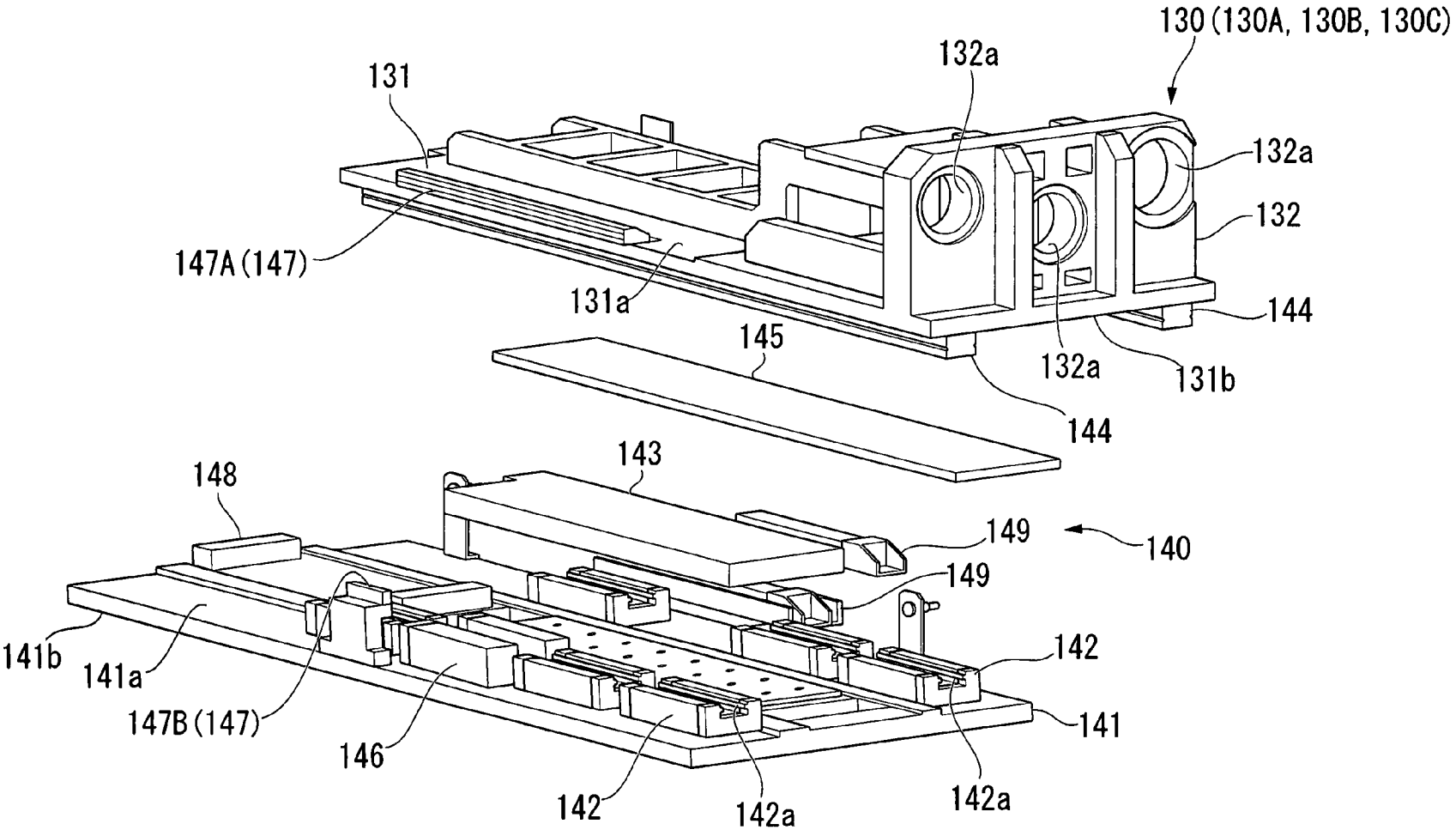
FIG. 4 is an exploded perspective view showing a structure of a working tool unit and a linear driving mechanism.
Figure 5:
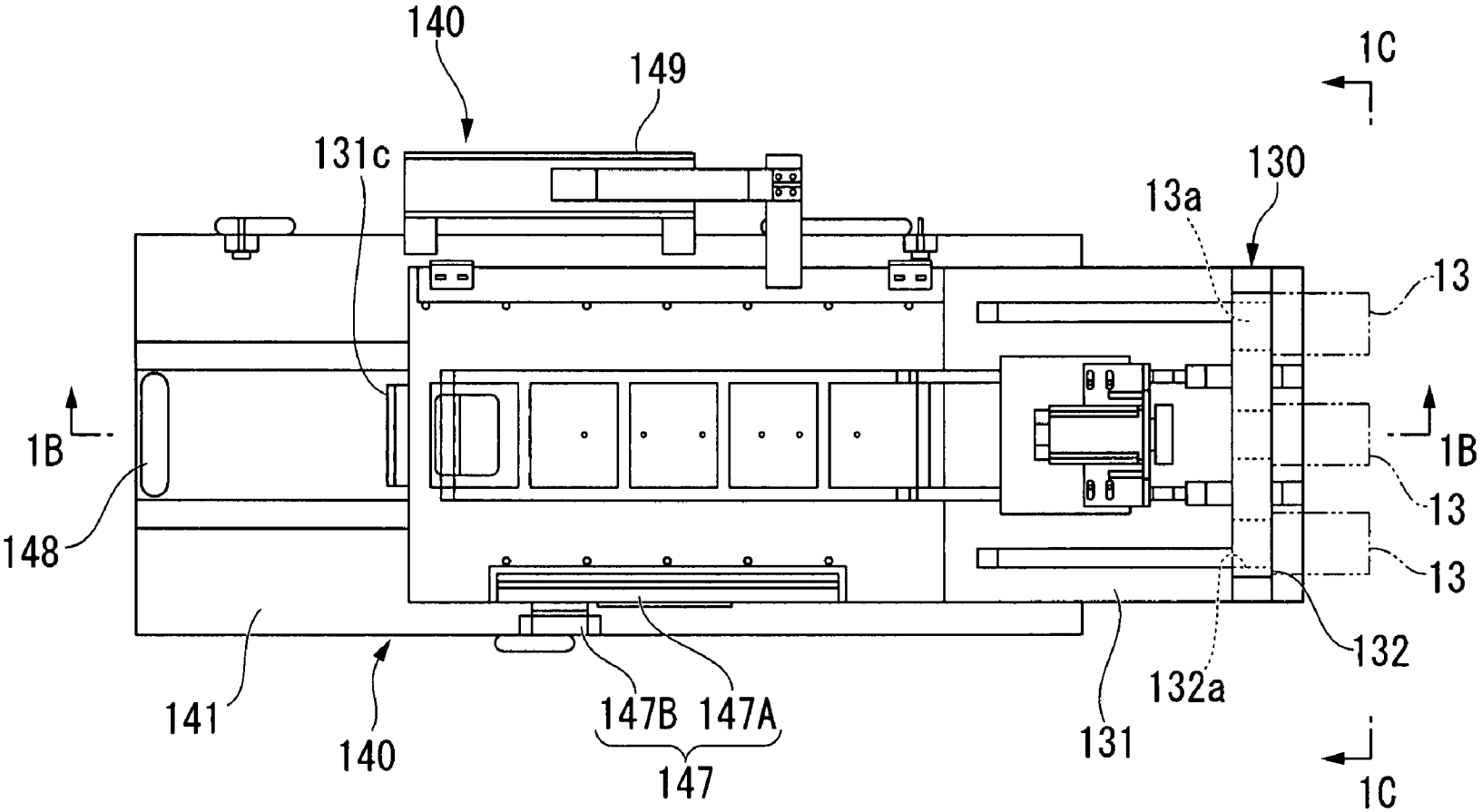
FIG. 5 is a top view showing the working tool unit joined on a base plate, seen from the top surface side thereof.
Figure 6:
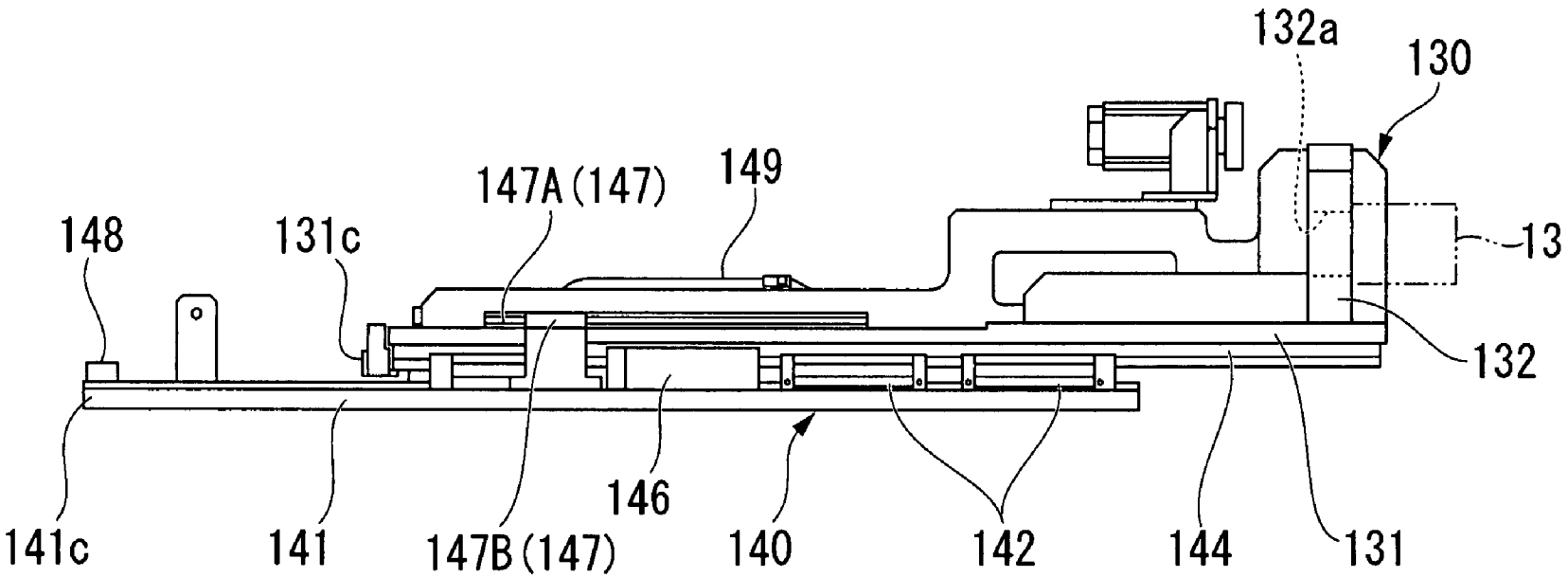
FIG. 6 is a side view showing the working tool unit joined on the base plate.
Figure 7:
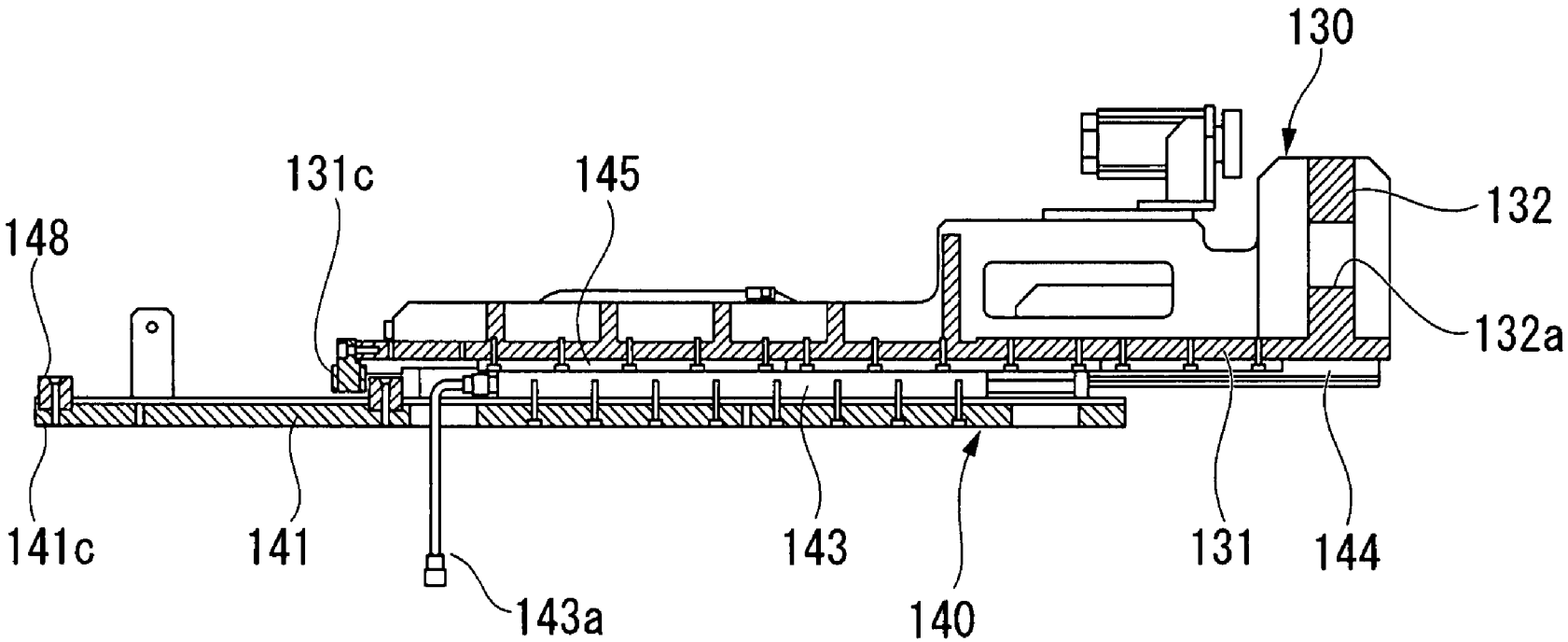
FIG. 7 is a sectional view showing the working tool unit and the linear driving mechanism shown in FIG. 5, taken along the line 1B-1B.
Figure 8:
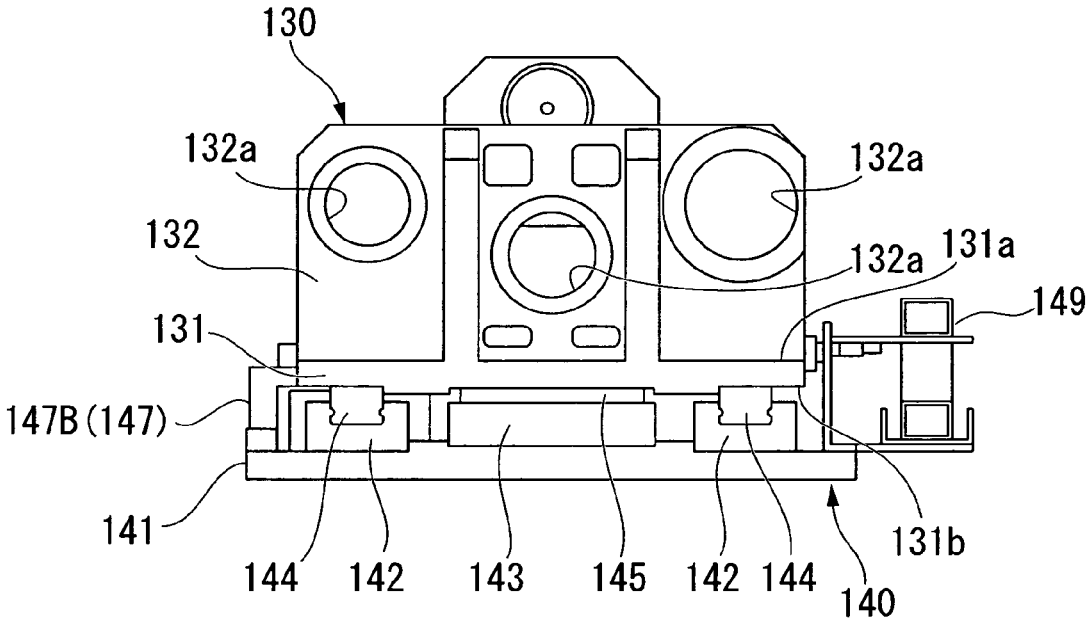
FIG. 8 is a fragmentary view showing the working tool unit and the linear driving mechanism shown in FIG. 5, taken along the line 1C-1C.

FIG. 1 is a side view showing a schematic configuration of a bottle can manufacturing device according to a first embodiment of the present invention, FIG. 2 is a perspective view showing a schematic configuration of a workpiece supporting base, FIG. 3 is a fragmentary view showing a tool supporting base shown in FIG. 1, taken along the line 1A-1A, FIG. 4 is an exploded perspective view showing a structure of a working tool unit and a linear driving mechanism, FIG. 5 is a top view showing the working tool unit joined on a base plate, seen from the top surface side thereof, FIG. 6 is a side view showing the working tool unit joined on the base plate, FIG. 7 is a sectional view showing the working tool unit and the linear driving mechanism shown in FIG. 5, taken along the line 1B-1B, and FIG. 8 is a fragmentary view showing the working tool unit and the linear driving mechanism shown in FIG. 5, taken along the line 1C-1C.

As shown in FIG. 1, a bottle can manufacturing device 11 according to the present embodiment is provided with a supporting frame 111, a workpiece supporting base 110 for rotating, on one side of the supporting frame 111, a workpiece 1W about a substantially horizontal rotation axis, and a tool supporting base 120 that is arranged facing the workpiece supporting base 110 with a predetermined clearance therefrom and that approaches and moves away from the workpiece 1W in the axial direction.

As shown in FIG. 2, the workpiece supporting base 110 is provided with a rotation shaft section 112 rotatably provided on the frame 111, and a workpiece supporting disk 113 supported on this rotation shaft section 112 so as to be able to rotate about the axis.

The workpiece supporting disk 113 is configured such that workpiece holders 12 capable of holding the bottom section of the bottom-ended cylinder-shaped workpiece 1W, are moved in the circumferential direction at every single working operation. That is to say, on the outer circumference section, facing the tool supporting base 120, of the workpiece supporting disk 113, there are arranged a number of workpiece holders 12 at predetermined pitches in an annular shape. The workpiece 1W held by each of the workpiece holders 12 is arranged so that the axis thereof becomes parallel with the rotational axis of the workpiece supporting disk 113. The workpiece supporting disk 113, together with the workpiece holders 12 and the workpiece 1W held thereby, can be intermittently rotated by a rotation driving device (not shown in the drawing) by a predetermined angle in the counterclockwise direction in FIG. 2 (direction shown by the arrow 1F in the drawing).

Moreover, as shown in FIG. 1, on the workpiece supporting base 110 there are provided a supplying section 114 that supplies the workpiece 1W to the workpiece supporting disk 113, and a discharging section 115 for discharging the finished workpiece 1W. FIG. 1 only shows the supplying section 114, and the supplying section 114 and the discharging section 115 are omitted in FIG. 2.

The supplying section 114 is supported so as to be able to rotate in synchronization with the intermittent rotation of the workpiece supporting disk 113, and is formed with a plurality of workpiece housing sections 114*a* in substantially a semi-circular hole shape with a diameter substantially equal to that of the workpiece 1W. It is configured such that the workpiece 1W that has been transported by a transporting device (not shown in the drawing) is received on the workpiece housing section 114*a*, and is transferred onto the workpiece holder 12 on the workpiece supporting disk 113 as the supplying section 114 rotates.

The discharging section 115 has a configuration similar to that of the supplying section 114 described above, and it is supported so as to be able to rotate in synchronization with the intermittent rotation of the workpiece supporting disk 113, and is formed with a plurality of workpiece housing sections 115*a* in substantially a semi-circular hole shape with a diameter substantially equal to that of the workpiece 1W. It is configured such that the workpiece 1W held by the workpiece supporting disk 113 is received on the workpiece housing section 115*a*, and is transferred to the transporting device or the like (not shown in the drawing) as the discharging section 115 rotates.

As shown in FIG. 3, the tool supporting base 120 supports a plurality of working tools 13 for performing working on the workpiece 1W, and is provided with working tool units 130 (130A, 130B, and 130C) being a plurality of units separated in the circumferential direction, in which the working tools 13 are arranged. As shown in FIG. 3 and FIG. 4, the working tool units 130A, 130B, and 130C are configured such that on the outer circumferential section thereof facing the workpiece supporting disk 113, a number of (three per single unit in the present embodiment) the working tools 13 are fixed in positions corresponding to the workpiece holders 12 provided on the workpiece supporting disk 113.

The working tool units 130A, 130B, and 130C are joined and supported on an outer supporting frame 121 (supporting member) via a linear driving mechanism 140 (sliding mechanism) including a linear motor, and are in a state of being capable of reciprocating motion in the axial direction of the workpiece 1W held by the workpiece supporting disk 113. That is to say, the working tool unit 130 is configured so as to be able to approach and move away from the workpiece 1W to thereby perform working on the workpiece 1W.

The outer supporting frame 121 is formed by an upper frame member 121*a* and side frame members 121*b* and 121*c* in a gate shape from a front view, and is fixed on a base plate 123. On the upper frame member 121*a* there is supported the upper tool unit 130A, and on the side frame members 121*b* and 121*c*, there are respectively supported the side tool units 130B and 130C. Consequently, within an inner region surrounded by the tool units 130A, 130B, and 130C, there is formed a space 1S.

As shown in FIG. 4 to FIG. 8, the working tool units 130 include a base 131, and a tool holding section 132 for fixing the plurality of working tools 13 vertically provided on one end thereof facing the workpiece supporting disk 113. That is to say, the base 131 and the tool holding section 132 are formed in a substantially L shape from a side view. The base 131 is arranged so that the lengthwise direction thereof is parallel to the axial direction of the workpiece 1W.

In the tool holding section 132, there are formed through holes 132*a* passing therethrough in the axial direction of the workpiece 1W (lengthwise direction of the base 131), through which base end sections 13*a* of the working tools 13 (refer to FIG. 1 and FIG. 5) are inserted to thereby be held. That is to say, the tool holding section 132 is such that the base end sections 13*a* of the working tools 13 are inserted through the respective through holes 132*a*, and thereby the working tools 13 with working end sections 13*b* that project so as to face the workpiece supporting disk 113, can be held. The working tools 13 held by the respective working tool units 130 are arranged in the rotational direction of the workpiece supporting disk 113, that is, are arranged in an order of workings to be made to the workpiece 1W.

Next, there is described, based on FIG. 4 to FIG. 8, the linear driving mechanism 140 for reciprocating the working tool units 130A, 130B, and 130C.

The linear driving mechanism 140 according to the present embodiment employs a linear motor well known in the art. As shown in FIG. 4, the linear driving mechanism 140 schematically includes a base plate 141, guide sections 142 that are fixed on one surface 141*a* of the base plate 141 and that are arranged along the axial direction of the workpiece 1W held by the workpiece supporting disk 113, an electromagnetic coil 143 fixed on the one surface 141*a* of the base plate 141, a pair of slide rails 144 that are fixed on a back surface 131*b* of the base 131 of the working tool unit 130 so as to be able to slide along the guide sections 142, and a magnet plate 145 that is fixed on the base 131 so as to face the electromagnetic coil 143 and that generates a thrust force between the electromagnetic coil 143 and the guide sections 142.

The base plate 141 is of a rectangular shape in plan view, and is arranged so that the lengthwise direction thereof matches the axial direction of the workpiece supporting disk 113, while a fixed surface 141*b* thereof (surface on the opposite side of the one surface 141*a*) is fixed on the outer supporting frame 121.

The guide sections 142, on the one surface 141*a* of the base plate 141, are provided, on both sides of the center axis, along the axial direction of the workpiece 1W. Specifically, each of the guide sections 142 is of a block body with a predetermined lengthwise dimension, in which there is formed a sectionally recessed engaging groove 142*a* that slidably engages with the slide rails 144, and a plurality of which are coaxially arranged at an appropriate spacing.

The electromagnetic coil 143 is of a flat plate shape, and is arranged, with a predetermined lengthwise dimension (length in the lengthwise direction of the base plate 141), between the guide sections 142 arranged in the two axial directions, while being fixed on the one surface 141*a* of the base plate 141. The electromagnetic coil 143 has a supply pipe 143*a* (refer to FIG. 7) for supplying coolant, provided in an appropriate position, and has a structure such that piping (not shown in the drawing) is internally installed in the entire electromagnetic coil 143 and coolant is flowed through this piping to thereby cool the electromagnetic coil 143.

The pair of slide rails 144 fixed on the working tool unit 130 extends in the lengthwise direction of the base 131 of the working tool unit 130, and engage within the engaging grooves 142*a* of the guide sections 42.

The magnet plate 145 is a flat plate magnet, and is arranged, with a predetermined lengthwise dimension (length in the lengthwise direction of the base 131), between the pair of slide rails 144, while being fixed on the back surface 131*b* of the base 131. That is to say, the structure is such that in a state where the slide rails 144 are engaging with the guide sections 142, the electromagnetic coil 143 and the magnet plate 145 are arranged in a state of facing each other with a predetermined clearance therebetween.

Moreover, in the linear driving mechanism 140, there are provided a clamp section 146 (engaging member) that is provided on the base plate 141 and that stops the sliding working tool unit, a position detecting device 147 that detects the position of the working tool unit 130, a stopper 148 provided at an end section in the direction of moving away from the workpiece supporting disk 113 on the base plate 141, and a power supply cable 149 that supplies electric power to the electromagnetic coil 143.

As shown in FIG. 4, the clamp section 146 is provided with brake pads (not shown in the drawing) that protrude toward the slide rail 144 so as to grip with a pressing force from both sides, the slide rail 144 that slides along the guide section 142, and is configured such that the brake pads engage with or release from the slide rail 144 based on ON/OFF switching of electric power. For example, the clamp section 146 has a configuration such that when electric power is conducted, the brake pads are protruded toward the slide rail 144 and are engaged with the slide rail 144 to thereby stop the movement of the slide rail 144, and when electric power is not conducted, the brake pads are moved in a direction away from the slide rail 144 to thereby release the slide rail 144.

The position detecting device 147 includes a scale member 147A provided on the working tool unit 130, for which a commonly known linear scale may be used, and a detecting section 147B provided on the base plate 141. The scale member 147A is a longitudinal scale member, and is arranged along the axial direction of the slide rail 144. That is to say, the position detecting device 147 is configured such that the detecting section 147B detects graduations on the scale member 147A, to thereby detect the position of the working tool unit 130.

As shown in FIG. 6 and FIG. 7, the stopper 148 is provided at an end section 141*c* on the backward (to which the working tool unit 130 moves away from the workpiece supporting disk 113) of the working tool unit 130 on the base plate 141, and is for regulating, at a predetermined position, the terminus of backward movement of the working tool unit 130. That is to say, in a case where the working tool unit 130 that is moving back is not stopped by the operation of the clamp section 146 described above, the working tool unit 130 can be stopped by bringing the rear end thereof into contact with the stopper 148. In addition, the structure is such that the stopper 148 is fixed on the base plate 141, and hence the weight of the working tool unit 130 is not increased.

Moreover, in the linear driving mechanism 140, the structure is such that the electromagnetic coil 143, the clamp section 146, and the detecting section 147B of the position detecting device 147 that require electric power supply, are fixed to the base plate 141. Therefore the power supply cable 149 is also provided to the base plate 141.

The linear driving mechanism 140 configured in this way is such that when electric power is conducted to the electromagnetic coil 143, a magnetic field is generated between the electromagnetic coil 143 and the magnet plate 145, and changes in the magnetic field cause the electromagnetic coil 143 and the magnet plate 145 to relatively move linearly in the axial direction of the slide rail 144. At this time, since the electromagnetic coil 143 is fixed via the base plate 141, on the outer supporting frame 121 (refer to FIG. 3), the configuration is such that the working tool unit 130 moves back and forth so as to approach and move away from the workpiece supporting disk 113.

Next, there are described, with reference to the drawings, a manufacturing method in which the workpiece 1W is formed with use of the present bottle can manufacturing device 11, and the operation of the present bottle can manufacturing device 11.

As shown in FIG. 1, FIG. 3, and FIG. 4, in the present bottle can manufacturing device 11, the following operations are sequentially repeated. The working tool units 130A, 130B, and 130C are advanced in a direction of approaching the workpiece supporting disk 113; the working tools 13 perform working on the respective workpieces 1W according to the respective steps; and every time when the working tool units 130A, 130B, and 130C complete one reciprocation in the advancing/retreating direction, the workpiece supporting disk 113 rotates by a predetermined angle and the workpiece 1W rotates by one pitch. More specifically, when the workpiece supporting disk 113 is intermittently rotated by only the pitch angle of one workpiece every time the working tool unit 130 performs one working operation, the workpiece holders 12 (workpieces 1W) are sequentially shifted and are then stopped to standby for the next working operation. Then having completed a single working operation, the working tool units 130A, 130B, and 130C are moved in reverse by the linear driving mechanism 140, and when they have sufficiently moved away from the workpiece 1W held on the workpiece supporting disk 113 so that interference is no longer present therebetween, the workpiece supporting disk 113 rotates again by only the pitch angle for one workpiece 1W, then stops, and performs the working operation again. This step is repeated and thereby working is sequentially performed on the workpieces 1W arranged between them and the shape-formation progresses. At the point in time when the series of workings are completed, a bottle can having a predetermined shape is completed. This bottle can is discharged from the discharging section and is transported to the next step.

The tool supporting base 120 that performs such a working operation has a structure in which the slide rails 144 are fixed on the working tool unit 130 and the working tool unit 130 is thereby reinforced. Consequently, it is possible to reduce the thickness dimension of the base 131 of the working tool unit 130 to thereby reduce the weight thereof. The weight-reduced working tool unit 130 is such that the member thereof are reinforced by the slide rails 144, and therefore deformation or distortion will not occur in the working tool unit 130 when the working tool unit 130 is reciprocation-moved so as to approach and move away from the workpiece supporting disk 113. Therefore it is possible to perform highly precise working while preventing problems where a working tool 13 is displaced with respect to the workpiece 1W. In addition, since the weight of the working tool unit 130 has been reduced, the outer supporting frame 121 that is fixed can be made smaller.

Furthermore, since the clamp section 146 is fixed on the base plate 141, it is possible to further reduce the weight of the working tool unit 130 that reciprocates.

Moreover, as shown in FIG. 7, since the electromagnetic coil 143 is in a position of being fixed on the base plate 141, the supply pipe 143*a* for supplying coolant to the electromagnetic coil 143 does not move together with the reciprocation of the working tool unit 130, and it is possible to prevent damage or breakage of the piping of the supply pipe 143*a*.

Furthermore, as shown in FIG. 3, the working tool units 130A, 130B, and 130C are in a configuration in which they are respectively connected via the linear driving mechanism 140 to the outer supporting frame 121 and can be individually driven. Consequently, for each of the working tool units 130A, 130B, and 130C, it is possible, for example, to change the reciprocation speed, shift the timing of approaching and moving away from the workpiece 1W, or change the stroke to thereby change the clearance between the workpiece 1W and the working tool 13, and thus it is possible to form bottle cans of various shapes.

As described above, in the bottle can manufacturing device according to the present embodiment, the structure is such that the slide rails 144 are fixed on the working tool unit 130 to thereby reinforce the working tool unit 130. Therefore it is possible to reduce the size and weight of the members of the working tool unit 130 while maintaining the rigidity of the members. Furthermore, the size of the outer supporting frame 121 that supports the working tool unit 130 can be made smaller. Therefore it is possible to prevent the bottle can manufacturing device 11 from becoming large in size.

An embodiment of the bottle can manufacturing device according to the present invention has been described. However, the present invention is not limited to the above embodiment, and appropriate modifications may be made thereto without departing from the scope of the invention.

For example, the configuration of the present embodiment is such that the working tool units 130 are made up of three units and three of the working tools 13 are arranged on each of the working tool units 130. However, the number of the working tool units 130, and the number of the working tools 13 to be arranged on each of the working tool units 130 are not limited to this configuration.

Moreover, in the present embodiment, the working tool units 130 are supported on the outer supporting frame 121. However, for example, they may be slidably supported, via the linear driving mechanism 140, on a supporting member provided on the inner side of the working tool units 130.

Second Embodiment

Hereunder, there is described another embodiment of the present invention, with reference to the drawings.

Figure 9:
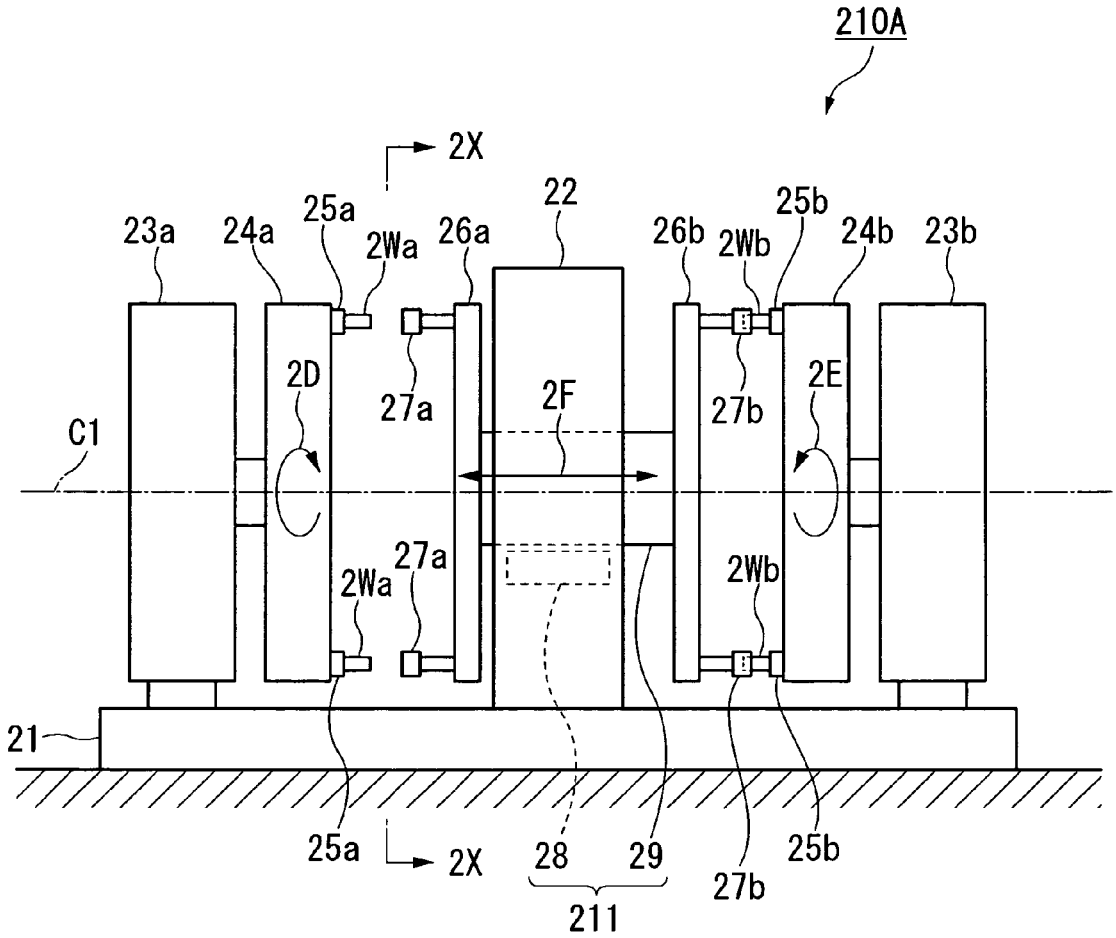
FIG. 9 is a schematic side view showing an overall configuration of a bottle can manufacturing device according to a second embodiment of the present invention.
Figure 10:
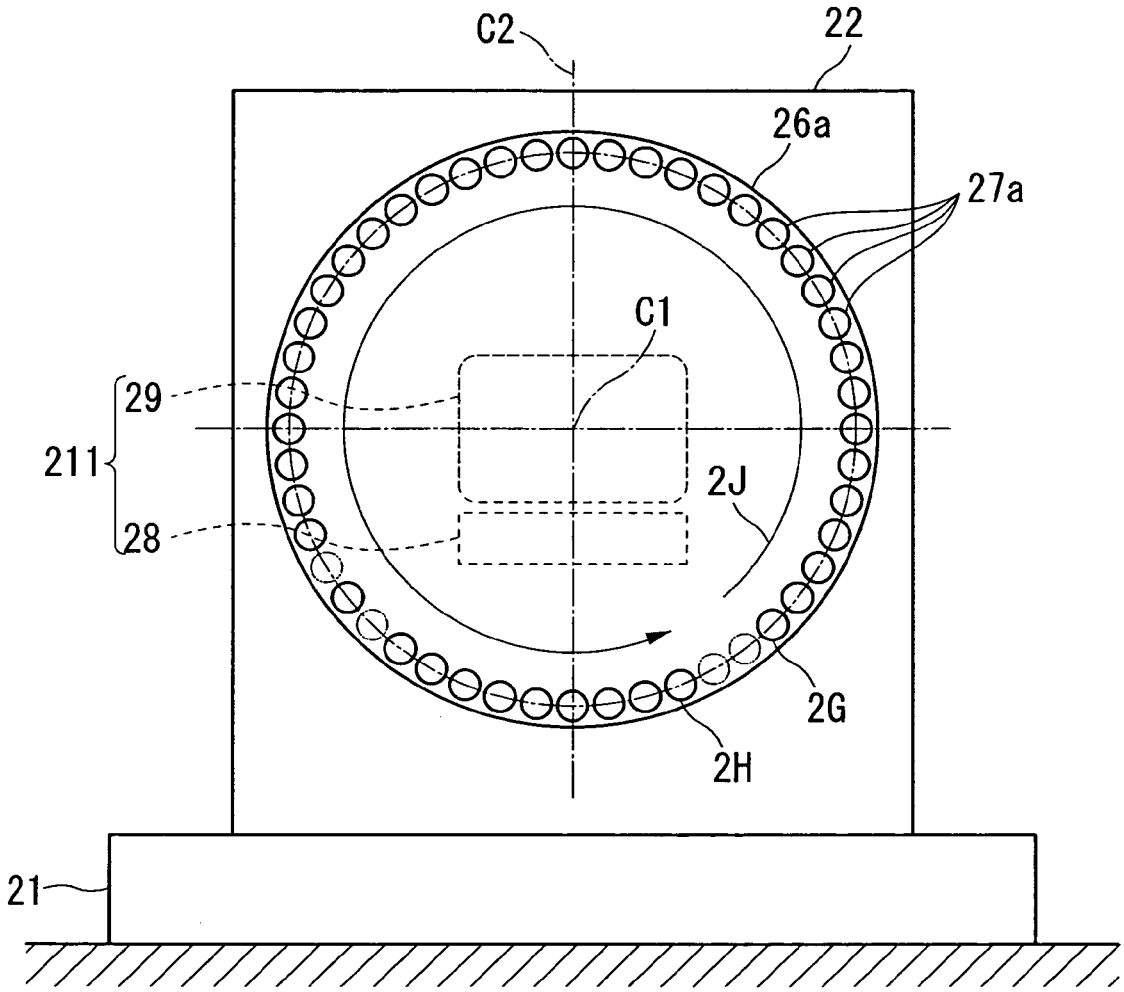
FIG. 10 is a fragmentary view taken along the line 2X-2X in FIG. 9.

FIG. 9 and FIG. 10 show a schematic configuration of a bottle can manufacturing device according to a second embodiment of the present invention.

This bottle can manufacturing device 210A, as shown in FIG. 9, is such that a base 21 supports a linear motor frame 22 at the approximate center of the upper surface thereof, and it supports a turntable frame 23*a* on one end thereof in the substantially horizontal direction (left side in FIG. 9) and a turntable frame 23*b* on the other end (right side in FIG. 9).

The turntable frame 23*a* supports a disk-shaped turntable 24*a* that faces the linear motor frame 22 and is provided intermittently rotatable about a rotational axis C1, and the turntable frame 23*b* supports a disk-shaped turntable 24*b* that faces the linear motor frame 22 and is provided intermittently rotatable about the rotational axis C1. Here, where the rotational direction of the turntable 24*a* is denoted by the arrow 2D and the rotational direction of the turntable 24*b* is denoted by the arrow 2E, there is provided a configuration in which the arrow 2D and the arrow 2E rotate about the rotational axis C1 in the same rotational direction (if the direction of the arrow 2D is taken as a clockwise direction when seen from the linear motor frame 22, the direction of the arrow 2E is a counterclockwise direction when seen from the linear motor frame 22). Moreover, the turntable 24*a* supports, in an annular shape in the proximity of the outer periphery thereof, a plurality of chuck units 25*a* that faces the linear motor frame 22 and is capable of holding the bottom section of a bottom ended cylinder-shaped workpiece 2Wa. The turntable 24*b* supports, in an annular shape in the proximity of the outer periphery thereof, a plurality of chuck units 25*b* that faces the linear motor frame 22 and is capable of holding the bottom section of a bottom ended cylinder-shaped workpiece 2Wb. Moreover, the workpieces 2Wa and 2Wb that are held and transported by the respective chuck units 25*a* and 25*b*, are arranged so that their axes are parallel with the rotational axis C1.

On a portion, facing the turntable 24*a*, of the linear motor frame 22, there is provided a disk-shaped die table 26*a* arranged so as to face the turntable 24*a*. The die table 26*a* supports, in an annular shape in the proximity of the outer periphery thereof, a plurality of working tools 27*a* arranged so as to face the chuck units 25*a*. On a portion, facing the turntable 24*b*, of the linear motor frame 22, there is provided a disk-shaped die table 26*b* arranged so as to face the turntable 24*b*. The die table 26*b* supports, in an annular shape in the proximity of the outer periphery thereof, a plurality of working tools 27*b* arranged so as to face the chuck units 25*b*.

Incidentally, the process of manufacturing a bottle can includes more than forty steps in total, including the steps of: lubricant application step, necking consisting of more than twenty steps to be performed on the region from the workpiece shoulder section to the opening section; and various types of rotation workings such as trimming for making uniform the opening end section, expanding for partially expanding the opening, threading for forming a screw thread in the opening section, curling for curling the opening end section, and throttle working to press the curled section.

FIG. 10 shows a sectional view taken along the line 2X-2X in FIG. 9. As shown in the drawing, the working tools 27*a* to be used in the above workings are arranged, in the vicinity of the outer periphery of the die table 26*a*, in an annular shape centered on the rotational axis C1. The working tools 27*a* are arranged along the direction of the arrow 2J from the position of 2G in the drawing to the position of 2H in the drawing, from the upstream toward the downstream of the workings, in the order of the steps. When the workpiece 2Wa has been supplied by a supplying device (not shown in the drawing) to the chuck unit 25*a* that is positioned facing the position of 2G in the drawing, it is transported along the direction of the arrow 2J due to the intermittent rotation of the turntable 24*a* while receiving the workings from the respective working tools 27*a* at the same time. Moreover, the configuration is such that having being transported to the chuck unit 25*a* that is positioned facing the position of 2H in the drawing and having completed receiving predetermined workings, it is discharged by a discharging device (not shown in the drawing). Here, among the working tools 27*a* supported on the die table 26*a*, a necking tool, which serves as a main working tool, is primarily arranged on the upstream in the working, and various types of rotational working tools are primarily arranged on the downstream in the working.

While not shown in the drawing, the working tools 27*b* on the die table 26*b* are arranged in the vicinity of the outer periphery of the die table 26*b*, in an annular shape centered on the rotational axis C1. Moreover, they are configured in an arrangement bilaterally-symmetric with the arrangement of the working tools 27*a* in FIG. 10 about the vertical axis C2 (hereunder, described as symmetric). When the workpiece 2Wb has been supplied by the supplying device to the chuck unit 25*b* that is positioned facing the position of 2G in the drawing, it is transported along a direction opposite to that of the arrow 2J due to the intermittent rotation of the turntable 24*b* while receiving the workings from the working tools 27*b* at the same time. Moreover, the configuration is such that having being transported to the chuck unit 25*b* that is positioned facing the symmetric position of 2H in the drawing and having completed the predetermined workings, it is discharged by the discharging device.

The die table 26*a* and the die table 26*b* are supported on both ends of a magnet 29 that passes through the linear motor frame 22 in the rotational axis C1 direction, and each of the die tables 26*a* and 26*b* is respectively arranged so as to face the turntable 24*a* or the turntable 24*b*. The magnet 29 is supported by the linear motor frame 22, and a coil slider 28 is supported by the linear motor frame 22 while being parallel to and in proximity to the magnet 29. The magnet 29 and the coil slider 28 form a liner motor 211, and the magnet 29 is configured so as to be able to be driven by the coil slider 28 to linearly reciprocate in the direction of the arrow 2F.

The configuration of the magnet 29 and the coil slider 28 may be reversed. That is to say, the configuration may be such that the coil slider 28 passes through the linear motor frame 22 in the rotational axis C1 direction and supports the die tables 26*a* and 26*b* on both ends thereof, and the magnet 29 is supported by the linear motor frame 22 in parallel proximity to the coil slider 28 while being able to drive the coil slider 28 to linearly reciprocate in the direction of the arrow 2F.

Next, there is described a method of manufacturing a bottle can with the bottle can manufacturing device configured as described above.

On one side of the linear motor frame 22 in the substantially horizontal direction (on the left side in FIG. 9), the workpiece 2Wa is supplied by the supplying device (not shown in the drawing) to the chuck unit 25*a* to be held. The turntable 24*a* that supports the chuck unit 25*a* is driven by the rotation driving device (not shown in the drawing) to repeat intermittent rotations in the direction of arrow 2D (clockwise direction when seen from the linear motor frame 22). The die table 26*a* supported on the one end of the magnet 29 is driven to linearly reciprocate in the direction of the arrow 2F in synchronization with the intermittent rotations of the turntable 24*a*, and repeats approaching and moving away from the turntable 24*a*. The working tools 27*a* supported on the die table 26*a* are arranged in the order of workings to be performed on the workpiece 2Wa, and every time when each of the tables 24*a* and 26*a* approaches and moves away from each other, each chuck unit 25*a* moves each workpiece 2Wa to a position where working is to be performed by the next working tool 27*a*, to thereby sequentially perform predetermined workings.

Moreover, on the other side of the linear motor frame 22 in the substantially horizontal direction (on the right side in FIG. 9), the workpiece 2Wb is supplied by the supplying device (not shown in the drawing) to the chuck unit 25*b* to be held. The turntable 24*b* that supports the chuck unit 25*b* is driven by the rotation driving device (not shown in the drawing) to repeat intermittent rotations in the direction of arrow 2E (counterclockwise direction when seen from the linear motor frame 22). The die table 26*b* supported on the other end of the magnet 29 is driven to linearly reciprocate in the direction of the arrow 2F in synchronization with the intermittent rotations of the turntable 24*b*, and repeats approaching and moving away from the turntable 24*b*. The working tools 27*b* supported on the die table 26*b* are arranged in the order of workings to be performed on the workpiece 2Wb, and every time when each of the tables 24*b* and 26*b* approaches and moves away from each other, each chuck unit 25*b* moves each workpiece 2Wb to a position where working is to be performed by the next working tool 27*b*, to thereby sequentially perform predetermined workings.

In this manner, the magnet 29 repeats the linear reciprocation movement to the one side and to the other side in the direction of the arrow 2F, and thereby workings for the workpiece 2Wa held by the chuck unit 25*a* and for the workpiece 2Wb held by the chuck unit 25*b* are respectively alternately performed on the one side and the other side. Specifically, while the working tool 27*a* approaches the chuck unit 25*a* and the working is performed on the workpiece 2Wa on the one side, on the other side, the working tool 27*b* moves away from the chuck unit 25*b* and the turntable 24*b* performs a rotation to thereby transport the workpiece 2Wb to the next working. Moreover, while the working tool 27*b* approaches the chuck unit 25*b* and the working is performed on the workpiece 2Wb on the other side, on the one side, the working tool 27*a* moves away from the chuck unit 25*a* and the turntable 24*a* performs a rotation to thereby transport the workpiece 2Wa to the next working.

On the one side and on the other side, predetermined workings are respectively performed and completed on the workpiece 2Wa and the workpiece 2Wb from the upstream to the downstream of the steps, and the workpieces are discharged by the discharging device (not shown in the drawing), to be supplied to the latter steps.

Figure 11:
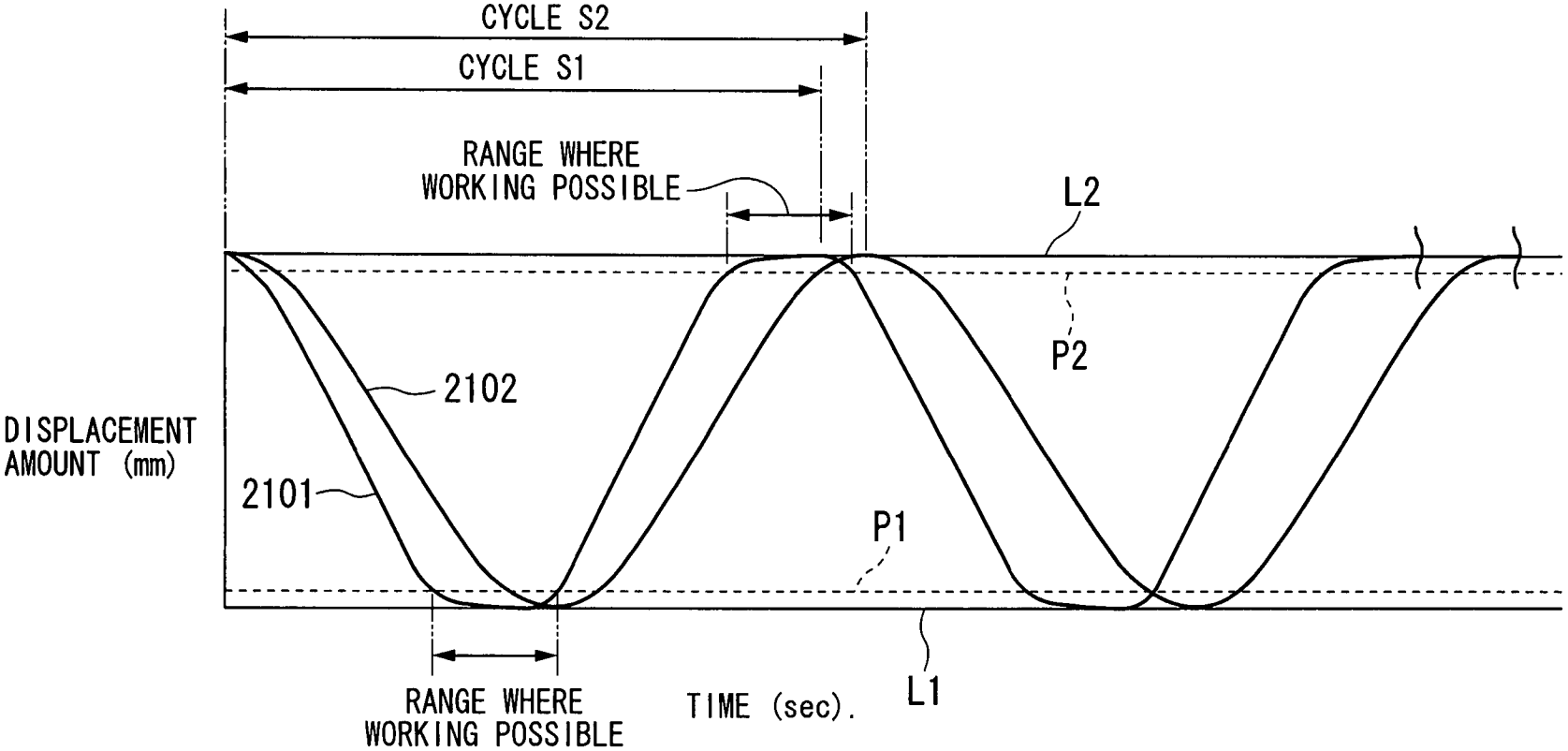
FIG. 11 is a graph showing stroke curves of a working tool according to the embodiment.

Next, in the graph of FIG. 11, the stroke curve 2101 is shown as a correlative relationship between: displacement amount (mm) representing the distance between the tool section of the working tools 27*a* and 27*b* supported on the die tables 26*a* and 26*b*, and the portion of the workpieces 2Wa and 2Wb to be worked by the tool section; and time (sec). Here, the horizontal axis represents time and the vertical axis represents displacement amount. The horizontal line L1 shown by the solid line shows the bottom dead point where the working tool 27*a* comes closest to the workpiece 2Wa on the one side, and the horizontal line P1 shown by the broken line shows a range in which in particular various types of rotational working tools can come to the vicinity of the workpiece 2Wa and perform working on the portion to be worked. Various types of rotational workings can be performed at the point of time where the stroke curve 2101 is present between the horizontal line P1 and the bottom dead point L1. Moreover, the horizontal line L2 shown by the solid line shows the bottom dead point where the working tool 27*b* comes closest to the workpiece 2Wb on the other side, and the horizontal line P2 shown by the broken line shows a range in which in particular various types of the rotational working tools can come to the vicinity of the workpiece 2Wb and perform working on the portion to be worked. Various types of the rotational workings can be performed at the point of time where the stroke curve 2101 is present between the horizontal line P2 and the bottom dead point L2. In the conventional workings performed only on one side, the range between the horizontal line P1 and the bottom dead point L1 was the only range in which workings can be performed, and workings could not be performed in a range between the horizontal line P2 and L2.

Here, the period of time for a single stroke of the stroke curve 2101 is shown as cycle S1 in the graph. Moreover, reference number 2102 denotes the stroke curve based on the conventional crank mechanism, and the period of time for a single stroke thereof is shown as cycle S2 in the graph. The stroke curve 2102 is for a crank mechanism, and it consequently draws a sine curve. In the stroke curve 2102, the period of time in which the tool stays between the horizontal line P1 and the bottom dead point L1, is determined in proportion to the length of the cycle S2. Therefore, if the cycle S2 is shortened, the time for the tool to stay in the possible working range will also get shortened in proportion thereto, consequently disabling performance of excellent working. The conventional mechanism had a limitation for reducing the cycle S2, and it was difficult to reduce the time to that shorter than the limited time while improving production efficiency at the same time.

On the other hand, in the stroke curve 2101 based on the linear motor, the curve to be formed can be freely configured. For example, as with the curve 2101 shown in the graph, it is possible, while performing working, to have the tool to stay between the horizontal line P1 and the bottom dead point L1 (or between the horizontal line P2 and the bottom dead point L2) for a long period of time, or conversely, to increase the movement speed of the linear motor to reduce the time when it is approaching or moving away, to thereby freely configure a time allocation for a single stroke. Thus, it is possible to reduce the cycle S1 while maintaining the working precision at an excellent level.

As described above, according to the bottle can manufacturing device and the bottle can manufacturing method of the present embodiment, the die tables 26*a* and 26*b* are linearly reciprocated in the direction of the arrow 2F by the linear motor 211. Furthermore while performing working on the workpiece 2Wa on the one side, the turntable 24*b* is rotated on the other side, and while performing working on the workpiece 2Wb on the other side, the turntable 24*a* is rotated on the one side. Therefore, with a single stroke, the total of two workings are performed on the one side and on the other side, and the workpieces are each transported to the next steps. Consequently, approximately twice the number of steps can be performed and thereby production efficiency can be significantly improved. Moreover, it is possible to prolong the working time where the working tools 27*a* and 27*b* approach the respective chuck units 25*a* and 25*b* and stay in the proximity of the bottom dead point, and to increase the movement speed thereof while they are approaching and moving away. Also it is possible to freely configure a time allocation for a single stroke. Moreover, it is possible to set the cycle of a single stroke to a value shorter than that in the conventional crank mechanism. Therefore, it is possible to improve production efficiency while maintaining the working precision for bottle cans at an excellent level.

Moreover, since the working tools 27*a* and 27*b* are directly driven by the linear motor 211 to linearly reciprocate, they can be made to approach and move away from the respective chuck units 25*a* and 25*b* without a number of transmission members intervening therebetween. Furthermore, direct driving enables to reduce mechanical load (such as frictional loss) and suppress power loss to a low level, and hence it is possible to reduce the scale of the device. Furthermore, it is possible to prevent variation in the movement of the working tools, noise, and vibration in a case where looseness occurs as conventionally observed associated with wear in transmission members due to long term use. Moreover, it is possible to prevent defects in bottle can working precision associated with thermal expansion in the transmission members due to wear. Furthermore, the driving mechanism of the die tables 26*a* and 26*b* becomes simplified, and therefore even if by any chance a problem occurs in the driving mechanism, it is possible to easily fix the cause of the problem and make an early recovery.

Modified Example of the Second Embodiment

Next, there is described a modified example of the second embodiment of the present invention.

Figure 12:
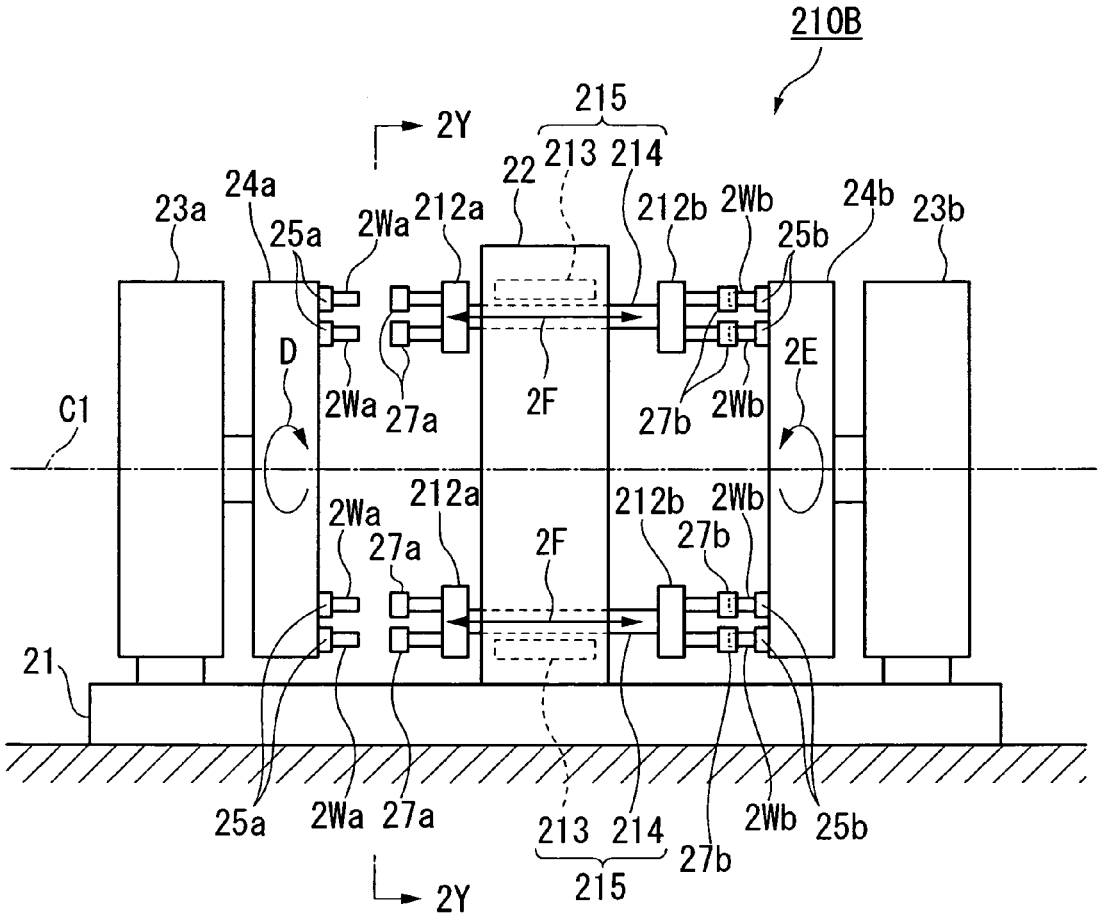
FIG. 12 is a schematic side view showing an overall configuration of a bottle can manufacturing device according to a modified example of the second embodiment of the present invention.
Figure 13:
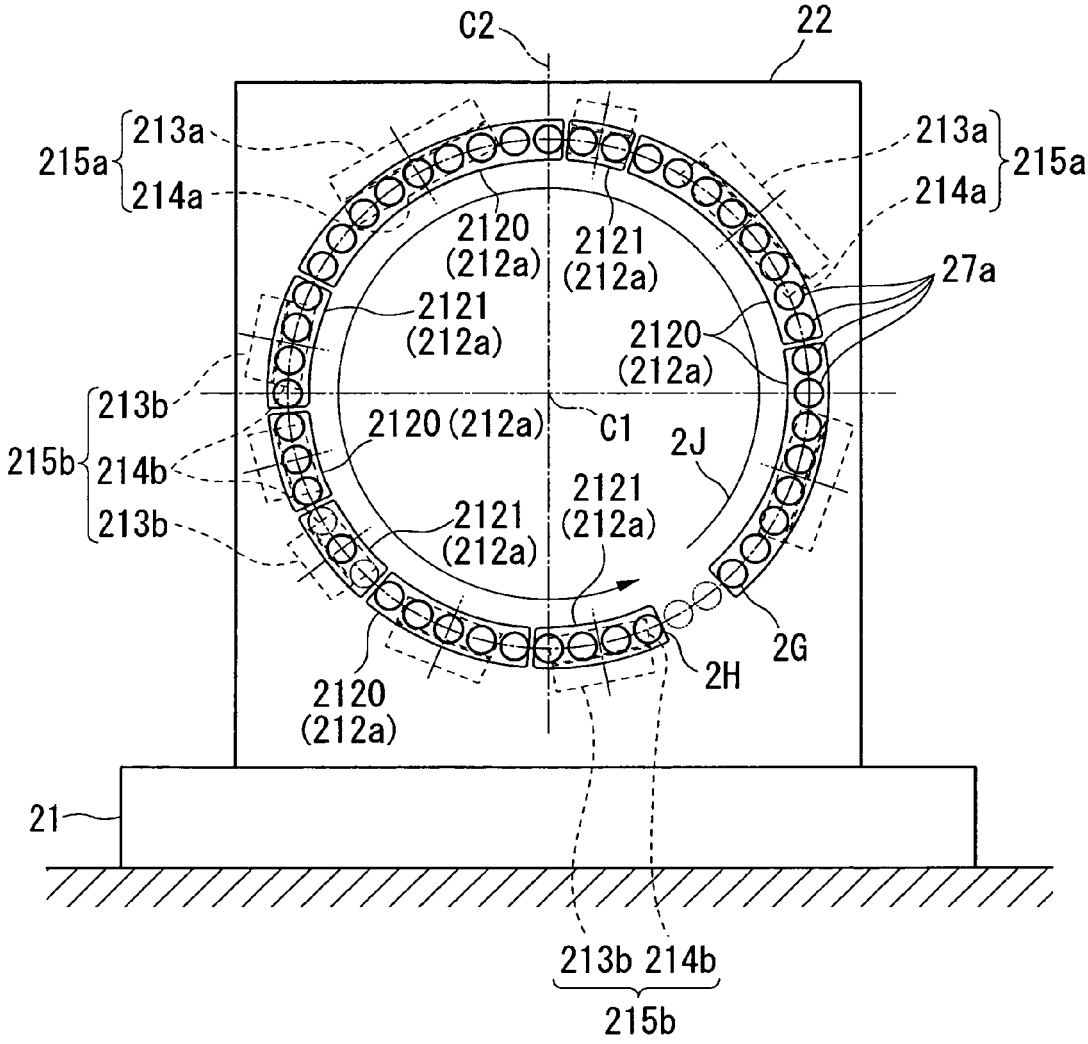
FIG. 13 is a fragmentary view taken along the line 2Y-2Y in FIG. 12.

FIG. 12 and FIG. 13 show a schematic configuration of a bottle can manufacturing device of the modified example of the second embodiment. Portions similar to those in the above second embodiment are given the same reference symbols and descriptions thereof are omitted.

This bottle can manufacturing device 210B is such that as shown in FIG. 12, on positions, facing the turntable 24*a*, of the linear motor frame 22, there a plurality of die units 212*a* arranged facing the turntable 24*a*, and each of the die units 212*a* supports one or a plurality of the working tools 27 arranged facing the chuck unit 25*a*. On positions, facing the turntable 24*b*, of the linear motor frame 22, there are provided a plurality of die units 212*b* arranged so as to face the turntable 24*b*, and each of the die units 212*b* supports one or a plurality of the working tools 27*b* arranged facing the chuck unit 25*b*.

FIG. 13 is a sectional view taken along the line 2Y-2Y in FIG. 12. The above plurality of die units 212*a*, as shown in the drawing, are arranged on the linear motor frame 22 in the shape of an arc centered on the rotational axis C1.

One or more of the working tools 27*a* are supported by the die units 212*a*, and are arranged along the direction of the arrow 2J from the position of 2G in the drawing to the position of 2H in the drawing, from the upstream toward the downstream of the workings, in the order of the steps.

When the workpiece 2Wa has been supplied by the supplying device (not shown in the drawing) to the chuck unit 25*a* that is arranged facing the position of 2G in the drawing, it is transported along the direction of the arrow 2J due to the intermittent rotation of the turntable 24*a* while receiving workings from the working tools 27*a* at the same time. Moreover, the configuration is such that having being transported to the chuck unit 25*a* that is positioned facing the position of 2H in the drawing and having completed receiving predetermined workings, it is discharged by a discharging device (not shown in the drawing). Here, among the working tools 27*a* supported on the die unit 212*a*, a necking tool, which serves as a main working tool, is primarily arranged on a die unit 2120 corresponding to the upstream of the working, and various types of rotational working tools are primarily arranged on a die unit 2121 corresponding to the downstream of the working. The necking tool performs working on the workpiece 2Wa primarily with a pressing force that occurs when the die unit 2120 and the turntable 24*a* come in close proximity to each other, and the operation thereof is linear and does not require much time. A number of these necking tools are grouped on the die unit 2120, and are supported on a normal speed linear motor 215*a*. On the other hand, the various types of rotational working tools, primarily in the vicinity of the bottom dead point where the tables come in closest proximity, place the tool on the inner side or outer side of the can opening section by means of a rotation centered on the axis of the target workpiece 2Wa, to thereby perform rotational workings, and the operation thereof is rotational and requires some time. One or a number of these rotational working tools are grouped on the die unit 2121, and are supported on a high speed linear motor 215*b*.

While not shown in the drawing, the plurality of the die units 212*b* are arranged on positions, facing the turntable 24*b*, of the linear motor frame 22, in the shape of an arc centered on the rotational axis C1. One or a plurality of the working tools 27*b* are supported on the die unit 212*b*, and are configured in an arrangement bilaterally-symmetric with the arrangement of the working tools 27*a* shown in FIG. 13 about the vertical axis C2 (hereunder, described as symmetric). When the workpiece 2Wb has been supplied by the supplying device to the chuck unit 25*b* that is arranged facing the position of 2G in the drawing, it is transported along a direction opposite to that of the arrow 2J due to the intermittent rotation of the turntable 24*b* while receiving the workings from the working tools 27*b* at the same time. Moreover, the configuration is such that having being transported to the chuck unit 25*b* that is positioned facing the symmetric position of 2H in the drawing and having completed the predetermined workings, it is discharged by the discharging device.

The die unit 212*a* and the die unit 212*b* are supported on both ends of each magnet 214 that passes through the linear motor frame 22 in the rotational axis C1 direction, and each of the die units 212*a* and 212*b* is arranged so as to face the turntable 24*a* or the turntable 24*b*. The magnet 214 is supported by the linear motor frame 22, and a coil slider 213 is supported by the linear motor frame 22 while being in parallel proximity to the magnet 214. The magnet 214 and the coil slider 213 form a liner motor 215, and the magnet 214 is configured so as to be able to be driven by the coil slider 213 to linearly reciprocate individually in the direction of the arrow 2F. Here, the normal speed linear motor 215*a* is configured with a magnet 214*a* and a coil slider 213*a*, and the high speed linear motor 215*b* is configured with a magnet 214*b* and a coil slider 213*b*.

The configuration of the magnet 214 and the coil slider 213 may be reversed. That is to say, the configuration may be such that each coil slider 213 passes through the linear motor frame 22 in the rotational axis C1 direction and supports the die tables 212*a* and 212*b* on both ends thereof, and each magnet 214 is supported by the linear motor frame 22 in parallel proximity to the coil slider 213 while being able to drive the coil slider 213 to linearly reciprocate in the direction of the arrow 2F.

Next, there is described a method of manufacturing a bottle can with the bottle can manufacturing device configured as described above.

On one side of the linear motor frame 22 in the substantially horizontal direction (on the left side in FIG. 12), the workpiece 2Wa is supplied by the supplying device (not shown in the drawing) to the chuck unit 25*a* to be held. The turntable 24*a* that supports the chuck unit 25*a* is driven by the rotation driving device (not shown in the drawing) to repeat intermittent rotations in the direction of arrow 2D (clockwise direction when seen from the linear motor frame 22). The die unit 212*a* supported on the one end of each magnet 214 is driven to linearly reciprocate in the direction of the arrow 2F in synchronization with the intermittent rotations of the turntable 24*a*, and repeats approaching and moving away from the turntable 24*a*. The working tools 27*a* supported on the die unit 212*a* are arranged in the order of workings to be performed on the workpiece 2Wa, and every time when the die unit 212*a* and the table 24*a* approach and move away from each other, each chuck unit 25*a* moves each workpiece 2Wa to a position where working is to be performed by the next working tool 27*a*, to thereby sequentially perform predetermined workings.

Moreover, on the other side of the linear motor frame 22 in the substantially horizontal direction (on the right side in FIG. 12), the workpiece 2Wb is supplied by the supplying device (not shown in the drawing) to the chuck unit 25*b* to be held. The turntable 24*b* that supports the chuck unit 25*b* is driven by the rotation driving device (not shown in the drawing) to repeat intermittent rotations in the direction of arrow 2E (counterclockwise direction when seen from the linear motor frame 22). The die unit 212*b* supported on the other end of each magnet 214 is driven to linearly reciprocate in the direction of the arrow 2F in synchronization with the intermittent rotations of the turntable 24*b*, and repeats approaching and moving away from the turntable 24*b*. The working tools 27*b* supported on each die unit 212*b* are arranged in the order of workings to be performed on the workpiece 2Wb, and every time when the die unit 212*b* and the turntable 24*b* approach and move away from each other, each chuck unit 25*b* moves each workpiece 2Wb to a position where working is to be performed by the next working tool 27*b*, to thereby sequentially perform predetermined workings.

In this manner, the magnet 214 repeats the linear reciprocation movement to the one side and to the other side in the direction of the arrow 2F, and thereby workings for the workpiece 2Wa held by the chuck unit 25*a* and for the workpiece 2Wb held by the chuck unit 25*b* are respectively alternately performed on the one side and the other side. Specifically, while the working tool 27*a* approaches the chuck unit 25*a* and the working is performed on the workpiece 2Wa on the one side, on the other side, the working tool 27*b* moves away from the chuck unit 25*b* and the turntable 24*b* performs a rotation to thereby transport the workpiece 2Wb to the next working. Moreover, while the working tool 27*b* approaches the chuck unit 25*b* and the working is performed on the workpiece 2Wb on the other side, on the one side, the working tool 27*a* moves away from the chuck unit 25*a* and the turntable 24*a* performs a rotation to thereby transport the workpiece 2Wa to the next working.

On the one side and on the other side, predetermined workings are performed and completed on the workpiece 2Wa and the workpiece 2Wb from the upstream to the downstream of the steps, and the workpieces are discharged by the discharging device (not shown in the drawing), to be supplied to the latter steps.

Figure 14:
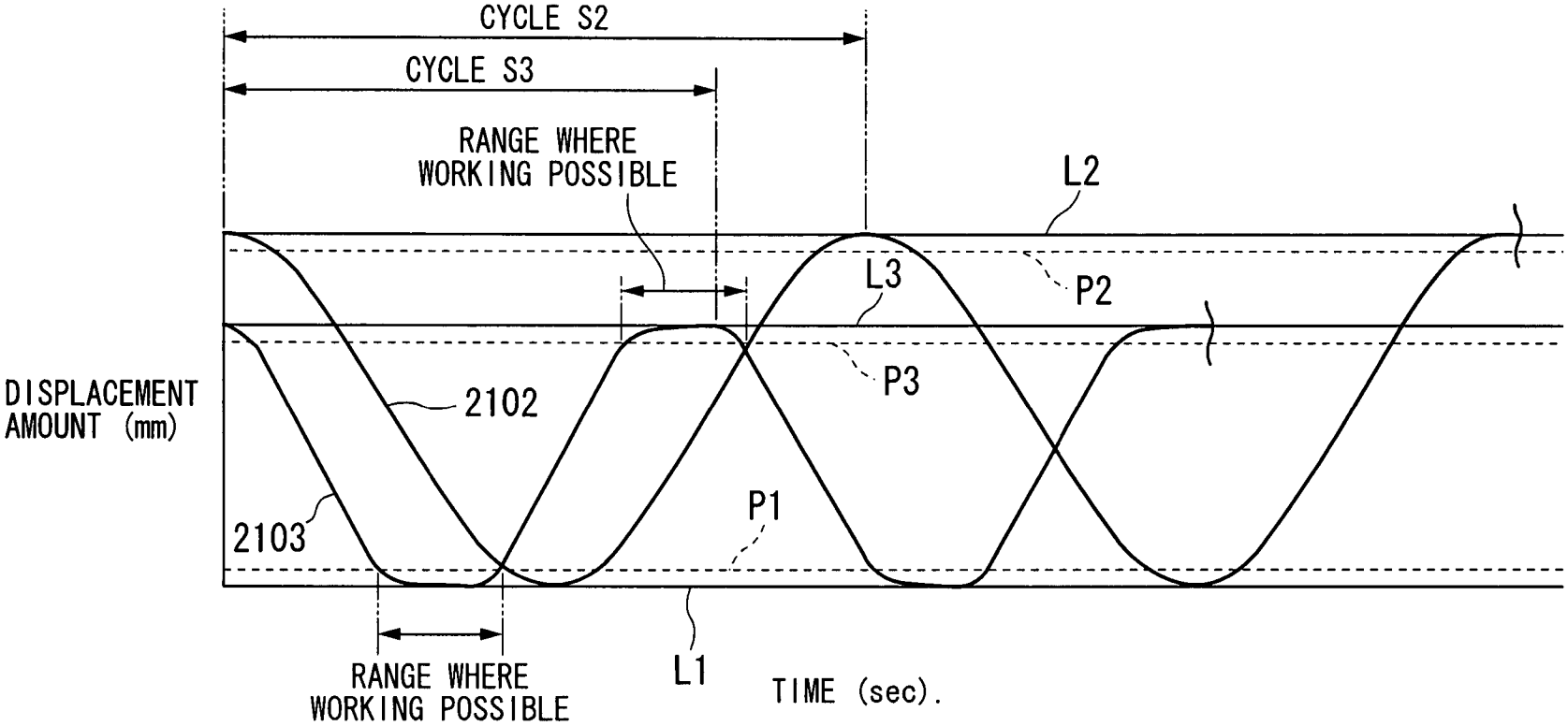
FIG. 14 is a graph showing stroke curves of a working tool according to the same modified example.

Next, in the graph of FIG. 14, the stroke curve 2103 is shown as a correlative relationship between: displacement amount (mm) representing the distance between the tool section of the working tools 27*a* and 27*b* supported on the die units 212*a* and 212*b*, and the portion of the workpieces 2Wa and 2Wb to be worked by the tool section; and time (sec). The horizontal line L1 shown by the solid line and the horizontal line P1 shown by the broken line are as described in the second embodiment, and various types of the rotational workings can be performed on the one side at the point of time where the stroke curve 2101 is present between the horizontal line P1 and the bottom dead point L1. Moreover, the horizontal line L3 shown by the solid line shows the bottom dead point where the working tool 27*b* comes closest to the workpiece 2Wb on the other side, and the horizontal line P3 shown by the broken line shows a range in which in particular various types of the rotational working tools can come to the vicinity of the workpiece 2Wb and perform working on the portion to be worked. Various types of the rotational workings can be performed at the point of time where the stroke curve 2103 is present between the horizontal line P3 and the bottom dead point L3.

Here, the period of time for a single stroke of the stroke curve 2103 is shown as cycle S3 in the graph. In the stroke curve 2103 based on the linear motor, as with the stroke curve 2101 described in the second embodiment, the curve to be formed can be freely configured. For example, as with the curve 2103 shown in the graph, it is possible, while performing working, to have the tool to stay between the horizontal line P1 and the bottom dead point L1 (or between the horizontal line P3 and the bottom dead point L3) for a long period of time, and to increase the movement speed of the linear motor to reduce the time when it is approaching or moving away, to thereby freely configure a time allocation for a single stroke. Thus, it is possible to reduce the cycle S3 while maintaining the working precision at an excellent level.

Incidentally, in the conventional stroke curve 2102, the working tools were supported all together on a single die table, and were made to approach and move away in a single stroke by a single crank mechanism that drives the die table. Consequently, it was necessary to set the amount of displacement for a single stroke (vertical axis direction amplitude of the curve) at a large value in conformity to the working tool that requires the longest stroke length in all of the working steps. However, in a configuration where linear motors 215 make the die units 212*a* and 212*b* individually approach and move away, the amount of displacement for a single stroke may be individually determined to suit the required stroke in one or a plurality of the working tools supported on the die units. Thus, it becomes possible for the various types of rotational working tools that comparatively do not require a very long stroke length and that primarily perform workings in the proximity of the bottom dead point, to take a short stroke length. Specifically, in FIG. 12, if the magnet 214 which drives the various types of rotational working tools to linearly reciprocate, is prepared with a length longer than usual so as to pass through the linear frame 22 and project to the one side and to the other side, the distance between the working tools 27*a* and 27*b* supported on the magnet 214, and the workpieces 2Wa and 2Wb, becomes shorter accordingly. Therefore it is possible to set the displacement amount per single stroke of the stroke curve 2103 (amplitude between the bottom dead point L1 and the bottom dead point L3) which is smaller than conventionally practiced as shown in FIG. 14. Moreover, this setting can be made for each magnet 214.

As has been described above, according to the bottle can manufacturing device and the bottle can manufacturing method of the present modified example, the die units 212*a* and 212*b* supporting one or a plurality of the respective working tools 27 and 27*b* can approach and move away from the turntables 24*a* and 24*b* with individual patterns. Therefore, it is possible to use the normal speed linear motor 215*a* for the necking that takes a typical amount of working time per single stroke and use the high speed linear motor 215*b* for the various types of rotational workings that take a comparatively longer time, to thereby individually decide a time allocation for each of the die units 2120 and 2121. Thus, a flexible configuration for each of the workings becomes possible, and economical and highly efficient production can be performed. Moreover, compared to the configuration such as with the conventional die table in which the entire disk is made to approach and move away, in the die units 212*a* and 212*b* according to the present invention, the weight mass thereof can be made smaller. Therefore it is possible to reduce the load on the driving devices.

The present invention is not limited to the above second embodiment and the modified example thereof, and various modifications may be made thereto without departing from the scope of the invention. For example, there may be provided a configuration in which the position of the turntable frames 23*a* and 23*b* can be adjusted on the base 21 in the direction of the rotational axis C1, so that the clearance between the working tool 27*a* and the workpiece 2Wa on the one side, is made different from the clearance between the working tool 27*b* and the workpiece 2Wb on the other side, to thereby enable simultaneous manufacturing of different types of cans on both sides.

Moreover, the above embodiment has the configuration in which the die table or die unit that supports the working tools is driven by the linear motor, and approaches and moves away from the turntables respectively arranged facing the one side and the other side of the linear motor frame. However, the configuration may be such that the turntable that supports the chuck units is driven by the linear motor, and approaches and moves away from the working tools respectively arranged facing the one side and the other side of the linear motor frame.

Furthermore, in a case where a cooling mechanism is provided in the linear motor of the above second embodiment, the linear motor frame may be provided with a coil slider, and the coil slider may be provided with a supply pipe for supplying coolant thereto. That is to say, the coil slider 28 may be supported on the linear motor frame 22, and this coil slider 28 may be provided with the supply pipe 143*a* for supplying coolant in the above first embodiment. In this case, the supply pipe 143*a* does not move together with the linear reciprocation of the working tools 27*a* (27*b*), and hence it is possible to prevent damage and breakage of the supply pipe 143*a*.

Third Embodiment

Hereunder, there is described, based on FIG. 15 to FIG. 19, a third embodiment of the can manufacturing device of the present invention and the can manufacturing method that uses this device.

Figure 15:
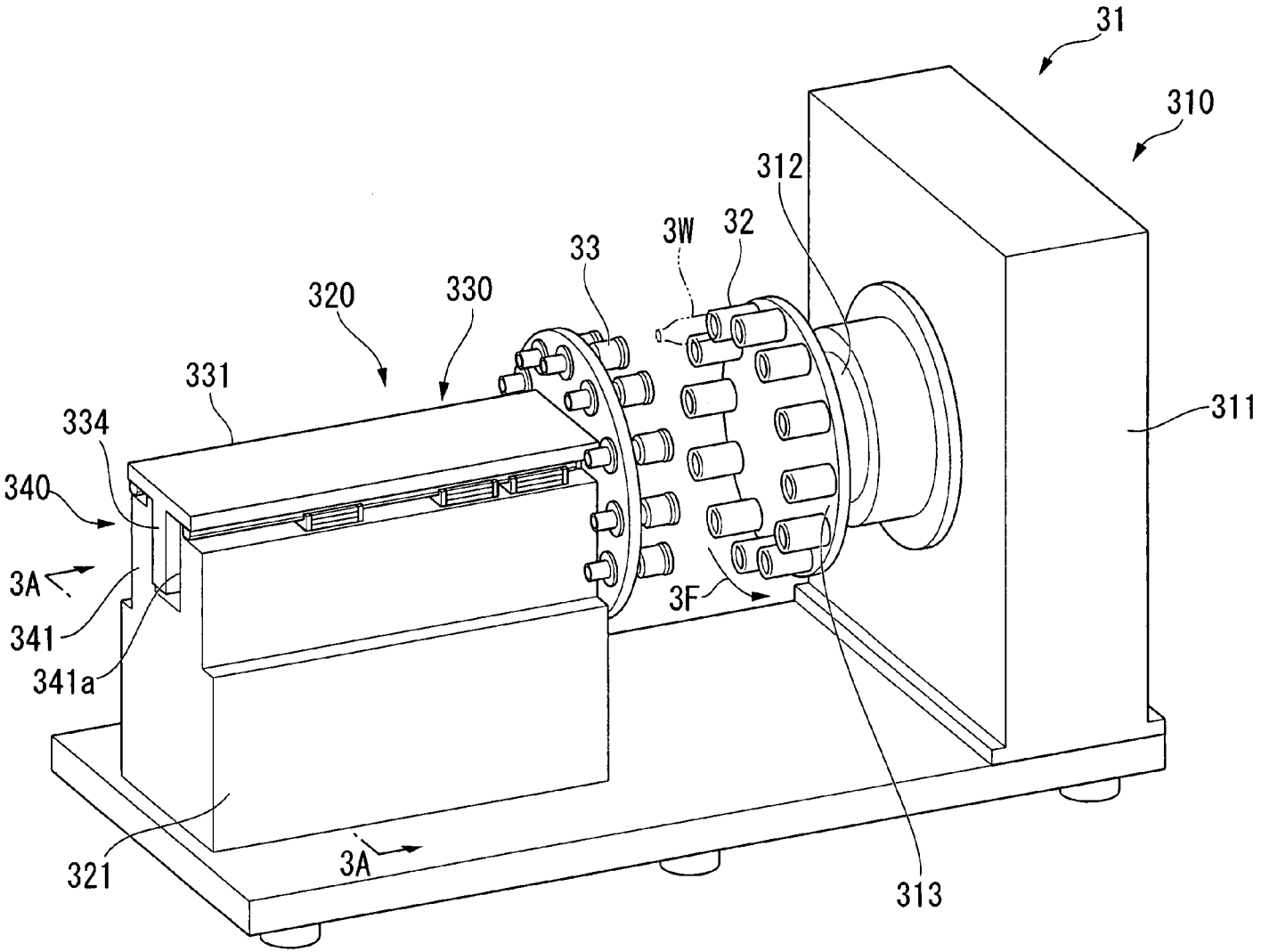
FIG. 15 is a perspective view showing a schematic configuration of a bottle can manufacturing device according to a third embodiment of the present invention.
Figure 16:
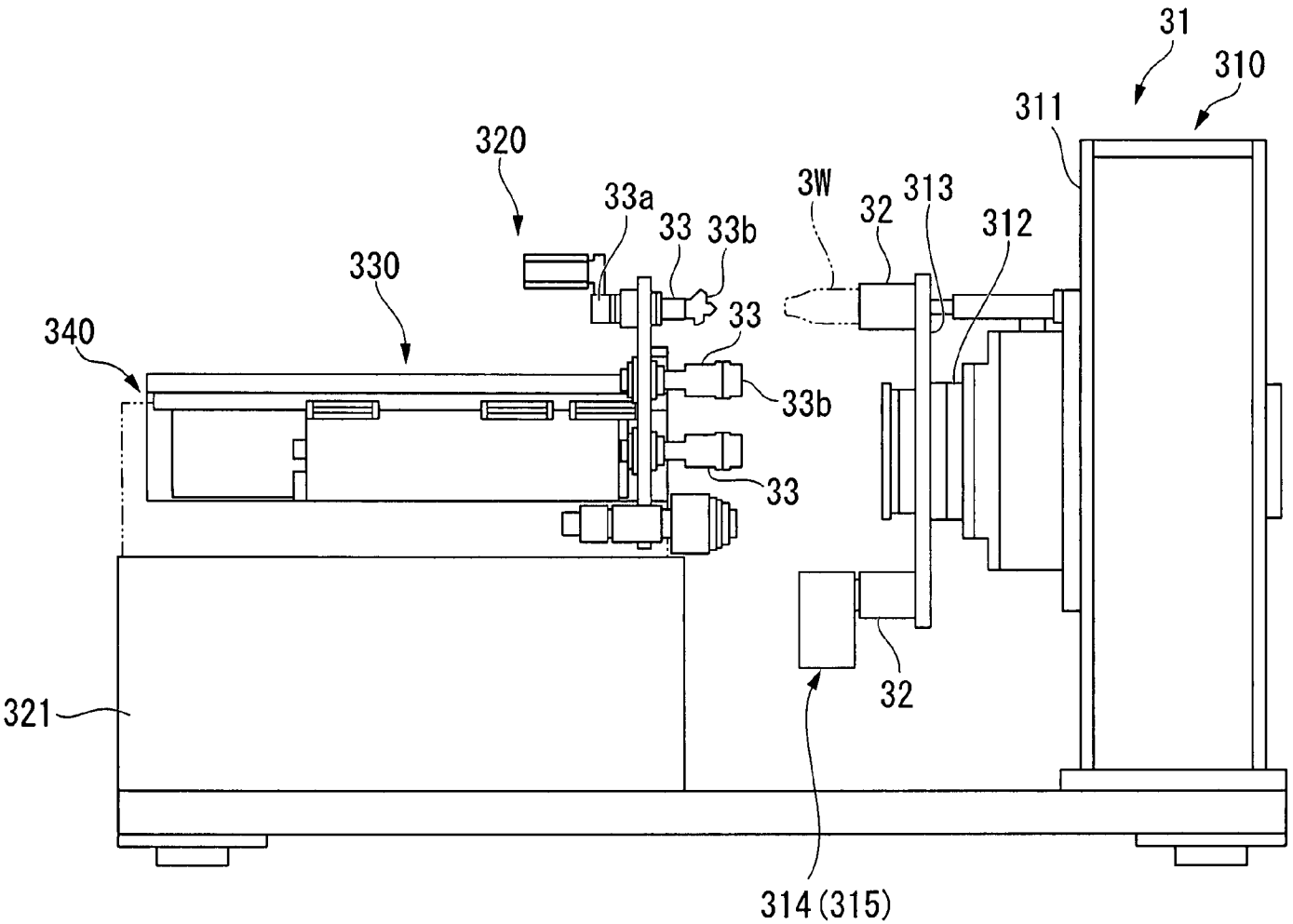
FIG. 16 is a partially exploded side view showing the bottle can manufacturing device shown in FIG. 15.
Figure 17:
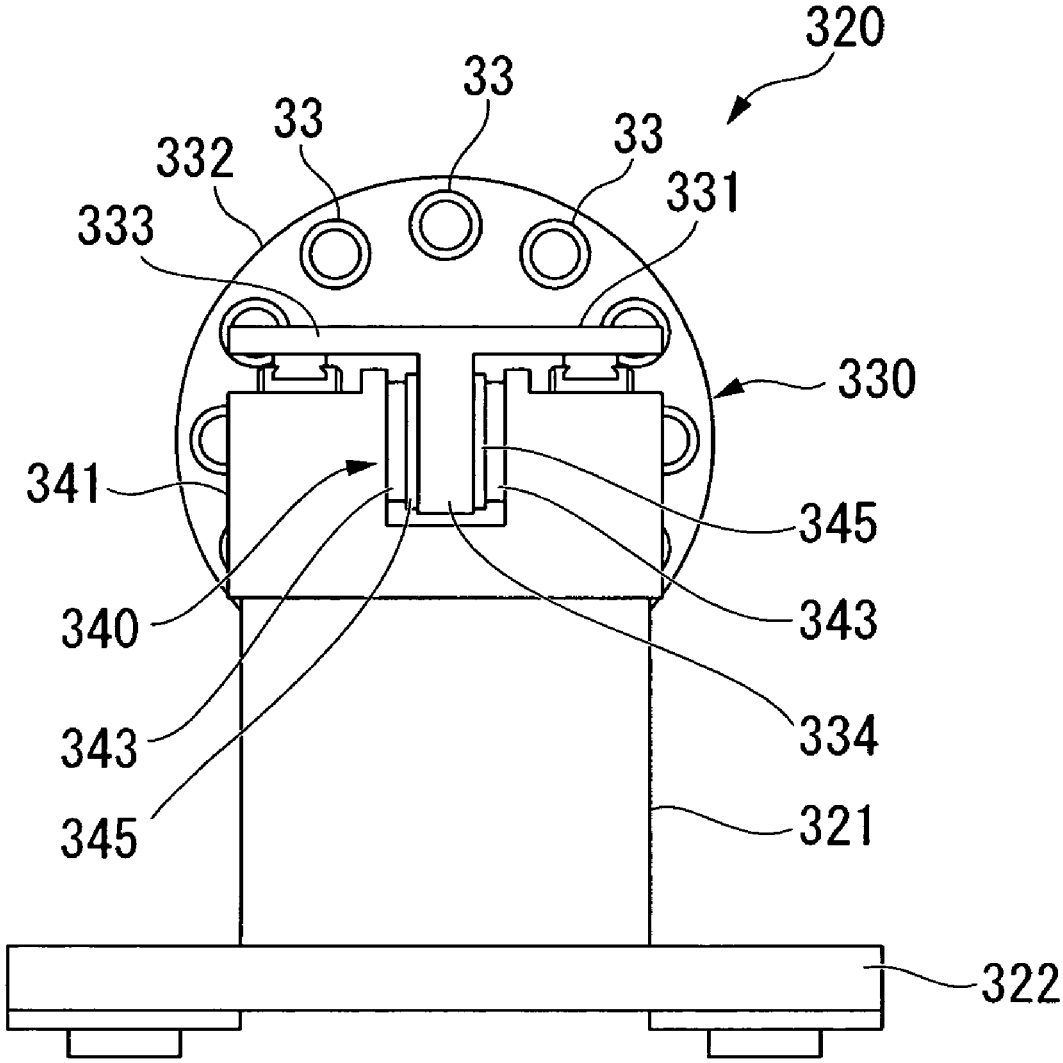
FIG. 17 is a fragmentary view showing a tool supporting base shown in FIG. 15, taken along the line 3A-3A.
Figure 18:
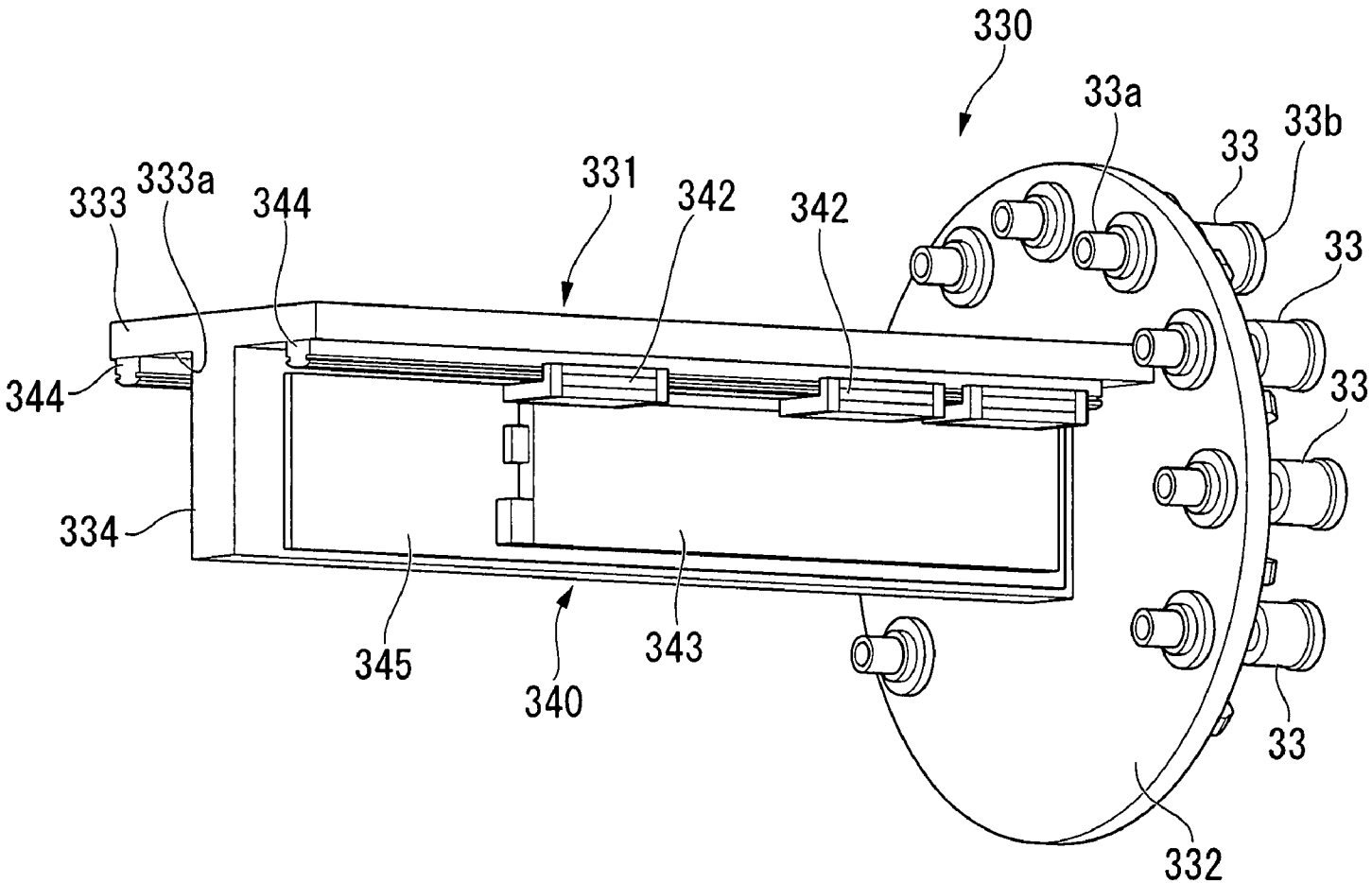
FIG. 18 is a partially exploded perspective view showing a structure of a working tool unit and a linear driving mechanism.
Figure 19:
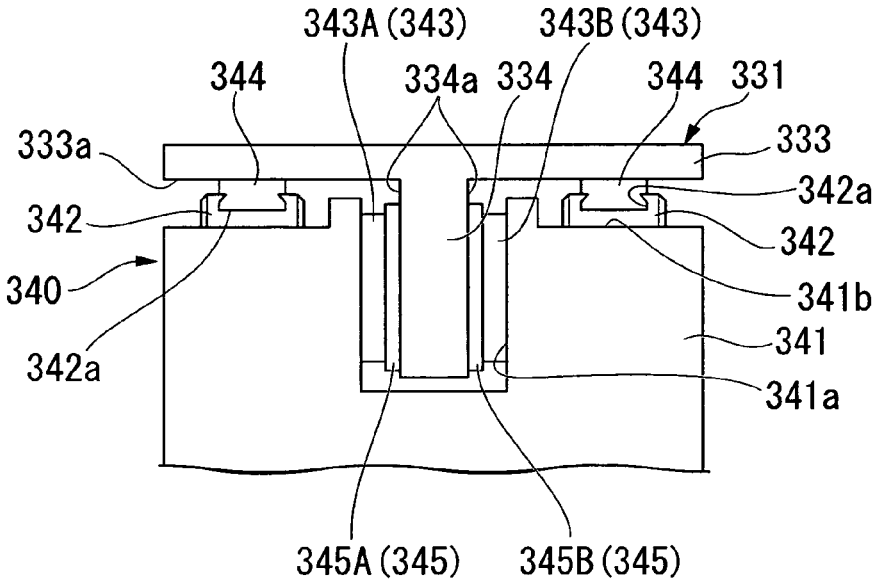
FIG. 19 is an enlarged view showing the relevant section of the linear driving mechanism shown in FIG. 17.

FIG. 15 is a perspective view showing a schematic configuration of a bottle can manufacturing device according to the third embodiment of the present invention, FIG. 16 is a partially exploded side view showing the bottle can manufacturing device shown in FIG. 15, FIG. 17 is a fragmentary view showing a tool supporting base shown in FIG. 15, taken along the line 3A-3A, FIG. 18 is a partially exploded perspective view showing a structure of a working tool unit and a linear driving mechanism, and FIG. 19 is an enlarged view showing the relevant section of the linear driving mechanism shown in FIG. 17.

As shown in FIG. 15 and FIG. 16, a bottle can manufacturing device 31 according to the present third embodiment is provided with a supporting frame 311, a workpiece supporting base 310 for rotating, on one side of the supporting frame 311, a workpiece 3W about the substantially horizontal rotation axis serving as the rotational center, and a tool supporting base 320 that is arranged facing the workpiece supporting base 310 with a predetermined clearance therefrom and that approaches and moves away from the workpiece 3W in the axial direction.

The workpiece supporting base 310 is provided with a rotation shaft section 312 rotatably provided on the frame 311, and a workpiece supporting disk 313 supported on this rotation shaft section 312 so as to be able to rotate about the axis.

The workpiece supporting disk 313 is configured such that workpiece holders 32 capable of holding the bottom section of the bottom-ended cylinder-shaped workpiece 3W, are moved in the circumferential direction at every single working operation. That is to say, on the outer circumference section, facing the tool supporting base 320, of the workpiece supporting disk 313, there are arranged a number of workpiece holders 32 at predetermined pitches in an annular shape. The workpiece 3W held by each of the workpiece holders 32 is arranged so that the axis thereof becomes parallel with the rotational axis of the workpiece supporting disk 313. The workpiece supporting disk 313, together with the workpiece holders 32 and the workpiece 3W held thereby, can be intermittently rotated by a rotation driving device (not shown in the drawing) by a predetermined angle in the counterclockwise direction in FIG. 15 (direction shown by the arrow 3F in FIG. 15).

Moreover, as shown in FIG. 16, on the workpiece supporting base 310 there are provided a supplying section 314 that supplies the workpiece 3W to the workpiece supporting disk 313, and a discharging section 315 for discharging the finished workpiece 3W. FIG. 16 only shows the supplying section 314, and the discharging section 315 is in a state of being hidden and invisible on the back face of the supplying section 314. Moreover, in FIG. 15, the supplying section 314 and the discharging section 315 are omitted.

The supplying section 314 is supported so as to be able to rotate in synchronization with the intermittent rotation of the workpiece supporting disk 313, and is formed with a plurality of workpiece housing sections (not shown in the drawing) in substantially a semi-circular hole shape with a diameter substantially equal to that of the workpiece 3W. It is configured such that the workpiece 3W that has been transported by a transporting device (not shown in the drawing) is received on the workpiece housing section, and is transferred onto the workpiece holder 32 on the workpiece supporting disk 313 as the supplying section 314 rotates.

The discharging section 315 has a configuration similar to that of the supplying section 314 described above, and it is supported so as to be able to rotate in synchronization with the intermittent rotation of the workpiece supporting disk 313, and is formed with a plurality of workpiece housing sections (not shown in the drawing) in substantially a semi-circular hole shape with a diameter substantially equal to that of the workpiece 3W. It is configured such that the workpiece 3W held by the workpiece supporting disk 313 is received on the workpiece housing section, and is transferred to the transporting device or the like (not shown in the drawing) as the discharging section 315 rotates.

As shown in FIG. 16 and FIG. 17, the tool supporting base 320 is provided with a working tool unit 330 that supports a plurality of working tools 33 for performing working on the workpiece 3W, and a linear driving mechanism 340 including a linear motor that reciprocates the working tool unit 330 in the axial direction of the workpiece 3W held on the workpiece supporting disk 313. That is to say, the working tool unit 330 is configured so as to be able to approach and move away from the workpiece 3W to thereby perform working on the workpiece 3W.

FIG. 18 is a drawing that omits a part of the linear driving mechanism 340 (supporting trestle 341 described later) for providing better understanding of the state of an electromagnetic coil 343 and a magnet 345 described later.

As shown in FIG. 17 and FIG. 18, the working tool unit 330 has a configuration in which on the outer periphery section facing the workpiece supporting disk 313 (refer to FIG. 15), a number of the working tools 33 are fixed in positions corresponding to the workpiece holders 32 provided on the workpiece supporting disk 313. The working tool unit 330 is provided on a fixed section 321 via the linear driving mechanism 340 (refer to FIG. 16 and FIG. 17). The fixed section 321 is fixed in the widthwise approximate center on a bottom plate when seen from the front (fragmentary view showing FIG. 15 taken along the line 3A-3A, shown in FIG. 17).

As shown in FIG. 18 and FIG. 19, the working tool unit 330 includes a T-shape base 331 (base) of a T-shape in cross-section, and a tool supporting disk 332 that is fixed on one end facing the workpiece supporting disk 313 (refer to FIG. 15) and that has a plurality (in nine locations in the present embodiment) of the working tools 33 arranged in the circumferential direction thereof.

The T-shape base 331 includes a flat plate section 333 and a projecting section 334 (projecting section) that projects from the approximate center, when seen on a sectional view, of the flat plate section 333 in the orthogonal direction, and is arranged so that the lengthwise direction thereof is in the axial direction of the workpiece 3W. On both of the outer side surfaces of the projecting section 334, there are fixed magnet plates 345 (345A and 345B) described later, and they slidably engage with a recessed groove section 341*a* of the supporting trestle 341 in the linear driving mechanism described later.

In the tool supporting disk 332, there are formed through holes (not shown in the drawing) passing therethrough in the axial direction of the workpiece 3W (lengthwise direction of the T-shape base 331), through which base end sections 33*a* of the working tools 33 (refer to FIG. 16 and FIG. 18) are inserted to thereby be held. That is to say, the tool supporting disk 332 is such that the base end sections 33*a* of the working tools 33 are inserted through the respective through holes, and thereby the working tools 33 with working end sections 33*b* that project so as to face the workpiece holders 32 of the workpiece supporting disk 313, can be held. The working tools 33 held by the respective working tool units 330 are arranged, according to the functions thereof, in the rotational direction of the workpiece supporting disk 313, that is, are arranged in an order of workings to be made to the workpiece 3W.

Next, there is described, based on FIG. 18 and FIG. 19, the linear driving mechanism 340 for reciprocating the working tool unit 330.

The linear driving mechanism 340 according to the present embodiment employs a linear motor well known in the art. The linear driving mechanism 340 schematically includes: the supporting trestle 341 provided on the fixed section 321 shown in FIG. 16 and FIG. 17; a pair of guide sections 342 that are fixed on the supporting trestle 341 and that are arranged along the axial direction of the workpiece 3W held by the workpiece supporting disk 313; electromagnetic coils 343 (343A and 343B) that, between these guide sections 342, are fixed on the supporting trestle 341; a pair of slide rails 344 that are fixed on a flat plate section back surface 333*a* of the T-shape base 331 of the working tool unit 330 and that can slide along the guide sections 342; and magnet plates 345 (345A and 345B) that, in positions facing the electromagnetic coils 343A and 343B, are fixed on the T-shape base 331.

As shown in FIG. 19, the supporting trestle 341 extends along the axial direction of the workpiece 3W (refer to FIG. 15), and in the widthwise (transverse direction) center of a top surface 341*b* thereof, there is formed a recessed groove section 341*a* with which the projecting section 334 of the T-shape base 331 engages while being allowed to slide along the axial direction. On both of the outer side surfaces 334*a* of the projecting section 334 of the T-shape base 331, there are fixed the magnet plates 345A and 345B. On the inner surface of the recessed groove section 341*a* described above, in a state where the projecting section 334 is engaged with the recessed groove section 341*a*, there are fixed the electromagnetic coils 343A and 343B in positions respectively facing the magnet plates 345A and 345B. That is to say, a combination of the electromagnetic coils 343 and the magnet plates 345 forms a configuration in which they are arranged on both sides of the projecting section 334 of the T-shape base 331, that is, a so-called double-side type linear driving method.

On the top surface 341*b* of the supporting trestle 341 (refer to FIG. 19), there are fixed a pair of the guide sections 342 arranged along the axial direction of the workpiece 3W held by the workpiece supporting disk 313. The guide sections 342 are arranged on both sides of the pair of the electromagnetic coils 343A and 343B, and the pair of the magnet plates 345A and 345B described above.

A plurality of (three on the same axis in the present embodiment) the guide sections 342, on the top surface 341*b* of the supporting trestle 341 as described above, are arranged on both sides of the recessed groove section 341*a*, on the axis of the workpiece 3W, at appropriate intervals. Specifically, each of the guide sections 342 is of a block body with a predetermined lengthwise dimension, in which there is formed a sectionally recessed engaging groove 342*a* that slidably engages with the slide rails 344.

The electromagnetic coils 343 are of a flat plate shape, and are arranged with a predetermined lengthwise dimension (length that extends in the lengthwise direction of the supporting trestle 341), between the guide sections 342 positioned on both sides of the recessed groove section 341*a*, while being fixed on both of the side surfaces of the recessed groove section 341*a* of the supporting trestle 341.

The magnet plates 345 are flat plate magnets, and are arranged, with a predetermined lengthwise dimension (length that extends in the lengthwise direction of the T-shape base 331), between the pair of slide rails 344, while being fixed on the back face 333*a* of the flat plate of the T-shape base 331. That is to say, in a state where the slide rails 344 are engaging with the guide sections 342, the electromagnetic coil 343 and the magnet plates 345 are arranged in a state of facing each other with a predetermined clearance therebetween.

Moreover, the linear driving mechanism 340 is provided with a clamp section (not shown in the drawing) that is provided on the supporting trestle 341 that is fixed, and that is to stop the sliding working tool unit 330. This clamp section is provided with brake pads that protrude toward the slide rail 344 so as to grip with a pressing force from both sides, the slide rail 344 that slides along the guide section 342, and is configured such that the brake pads engage with or release from the slide rail 344 based on ON/OFF switching of electric power. For example, the clamp section has a configuration such that when electric power is conducted, the brake pads are protruded toward the slide rail 344 and are engaged with the slide rail 344 to thereby stop the movement of the slide rail 344, and when electric power is not conducted, the brake pads are moved in a direction away from the slide rail 344 to thereby release the slide rail 344.

The linear driving mechanism 340 configured in this way is such that when electric power is conducted to the electromagnetic coil 343, a magnetic field is generated between the electromagnetic coil 343 and the magnet plate 345, and changes in the magnetic field cause the electromagnetic coil 343 and the magnet plate 345 to relatively move linearly in the axial direction of the workpiece 3W. That is to say, the linear driving mechanism 340 is configured such that a thrust force is generated for the guide sections 342 between the electromagnetic coils 343 and the magnet plates 345, and thereby the slide rails 344 slide along the guide sections 342. That is to say, since the electromagnetic coils 343 are fixed via the supporting trestle 341, on the fixed section 321 (refer to FIG. 17), the configuration is such that the working tool unit 330 moves back and forth so as to approach and move away from the workpiece supporting disk 313.

Next, there are described, with reference to the drawings, a manufacturing method in which the workpiece 3W is formed with use of the present bottle can manufacturing device 31, and the operation of the present bottle can manufacturing device 31.

As shown in FIG. 15 and FIG. 16, in the present bottle can manufacturing device 31, the following operations are sequentially repeated. The tool supporting disk 332 of the working tool unit 330 is advanced in a direction of approaching the workpiece supporting disk 313; the working tools 33 perform workings on the respective workpieces 3W according to the steps; and every time the working tool unit 330 completes one reciprocation in the advancing/retreating direction, the workpiece supporting disk 313 rotates by a predetermined angle and the workpiece 3W rotates by one pitch.

More specifically, when the workpiece supporting disk 313 is intermittently rotated by only the pitch angle of one workpiece every time the working tool unit 330 performs one working operation, the workpiece holders 32 (workpieces 3W) are sequentially shifted and are then stopped to standby for the next working operation. Then having completed a single working operation, the working tool unit 330 is moved in reverse by the linear driving mechanism 340, and when it has sufficiently moved away from the workpiece 3W held on the workpiece supporting disk 313 so that interference is no longer present therebetween, the workpiece supporting disk 313 rotates again by only the pitch angle for one workpiece 3W, then stops, and performs the working operation again. This step is repeated and thereby working is sequentially performed on the workpieces 3W arranged between them and the shape-formation progresses. At the point in time when the series of workings are completed, a bottle can having a predetermined shape is completed. This bottle can is discharged from the discharging section and is transported to the next step.

As shown in FIG. 17 to FIG. 19, in the tool supporting base 320 that performs such working operations, a magnetic field is generated between the electromagnetic coils 343 and the magnet plates 345 on both sides of the projecting section 334 of the T-shape base 331, and thereby the electromagnetic coils 343 and the magnet plates 345 are linearly relatively moved in the axial direction of the workpiece 3W. Consequently, the working tool unit 330 can be made to approach and move away from the workpiece supporting base 310 (refer to FIG. 15), and thereby the working tool 33 can perform workings on the workpiece 3W.

Since the configuration forms a double-side type linear driving method in which the electromagnetic coils 343 and the electromagnetic plates 345 are provided on both sides of the projecting section 334, compared to that of the single-side type linear driving method with the same thrust force, it is possible to reduce the magnetic attraction force to an approximately 1/10 level. Consequently, the load applied on the members that fix and support the electromagnetic coils 343 and the magnetic plates 345 becomes smaller, and the size and weight of the working tool unit 330 can be reduced.

Therefore, it is possible to suppress vibrations in the working tool unit 330 when it reciprocates.

Moreover, the working tool unit 330 is supported from the underside by the supporting trestle 341, and there is no frame on the outer side of the working tool unit 330. It is therefore possible to ensure an operating space for installation and maintenance of the working tools 33, and operation efficiency can be consequently improved.

As described above, in the can manufacturing device according to the present third embodiment and the can manufacturing method that uses this device, there is provided a configuration forming the double-side type linear driving method in which the electromagnetic coils 343 and the electromagnetic plates 345 are provided on both sides of the projecting section 334 of the T-shape base 331. Therefore it is possible to make the magnetic attraction force smaller than that of the single-side type linear driving method with the same thrust force. Consequently, the load applied on the members that fix and support the electromagnetic coils 343 and the magnetic plates 345 becomes smaller, and the size and weight of the working tool unit can be reduced. Therefore, it is possible to suppress vibrations in the working tool unit when it reciprocates, and consequently it is possible to prevent problems where the working tool is displaced with respect to the workpiece, prevent defective working on the bottle cans, and improve working precision.

Modified Examples of the Third Embodiment

Next, a first modified example and a second modified example of the present embodiment are described with reference to the drawings. Members or portions the same as or similar to those in the third embodiment described above are given the same reference symbols and descriptions thereof are omitted, and only the difference from that in the third embodiment will be described.

Figure 20:
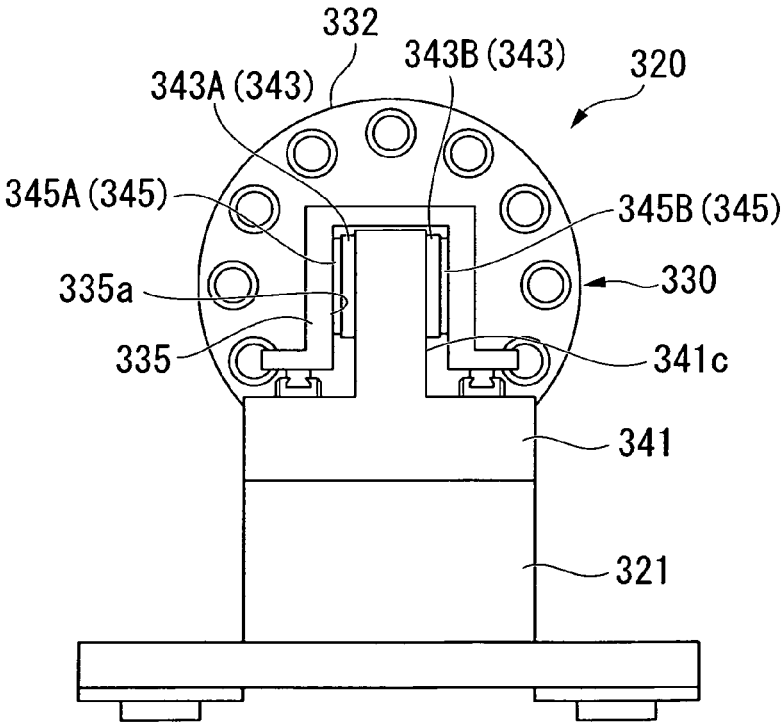
FIG. 20 is a front view showing a structure of a tool supporting base according to a first modified example of the third embodiment of the present invention, and is a drawing corresponding to FIG. 17.

FIG. 20 is a front view showing a structure of a tool supporting base according to the first modified example of the third embodiment of the present invention, and is a drawing corresponding to FIG. 17.

As shown in FIG. 20, the T-shape base 331 is employed for the working tool unit 330 in the third embodiment (refer to FIG. 17). However, instead of this, in the present modified example, a recessed base 335 (base) is employed. Moreover, in the above third embodiment, the shape of the supporting trestle 341 forms the recessed groove section 341*a* (refer to FIG. 17), however, in the present modified example, a projecting section 341*c* (projecting section) is formed in the structure instead.

That is to say, in the working tool unit 330, there is formed a recessed groove section 335*a* with the bottom surface thereof open when seen from the front, and on the lengthwise one end thereof (on the end section facing the workpiece supporting base 310 shown in FIG. 15), there is provided the recessed base 335 with the tool supporting disk 332 fixed thereon. On the supporting trestle 341, there is formed the projecting section 341*c* with which the recessed groove section 335*a* slidably engages along the axial direction of the workpiece 3W.

On both side surfaces of the projecting section 341*c*, there are fixed the electromagnetic coils 343 (343A and 343B). On the inner side surfaces of the recessed groove section 335*a*, in a state where the projecting section 341*c* is engaging with the recessed groove section 335*a*, there are fixed the magnet plates 345 (345A and 345B) so as to face the respective electromagnetic coils 343A and 343B. That is to say, in the present modified example, as with the above third embodiment, a combination of the electromagnetic coils 343 and the magnet plates 345 forms a configuration, in which they are arranged on both sides of the projecting section 341*c* of the supporting trestle 341, that is, a so-called bilateral type linear driving method.

Thus, in the present modified example, there is provided the double-side type linear driving method as with the above third embodiment. Therefore it is possible to reduce the size and weight of the working tool unit 330, while suppressing vibrations that occur in reciprocation.

Figure 21:
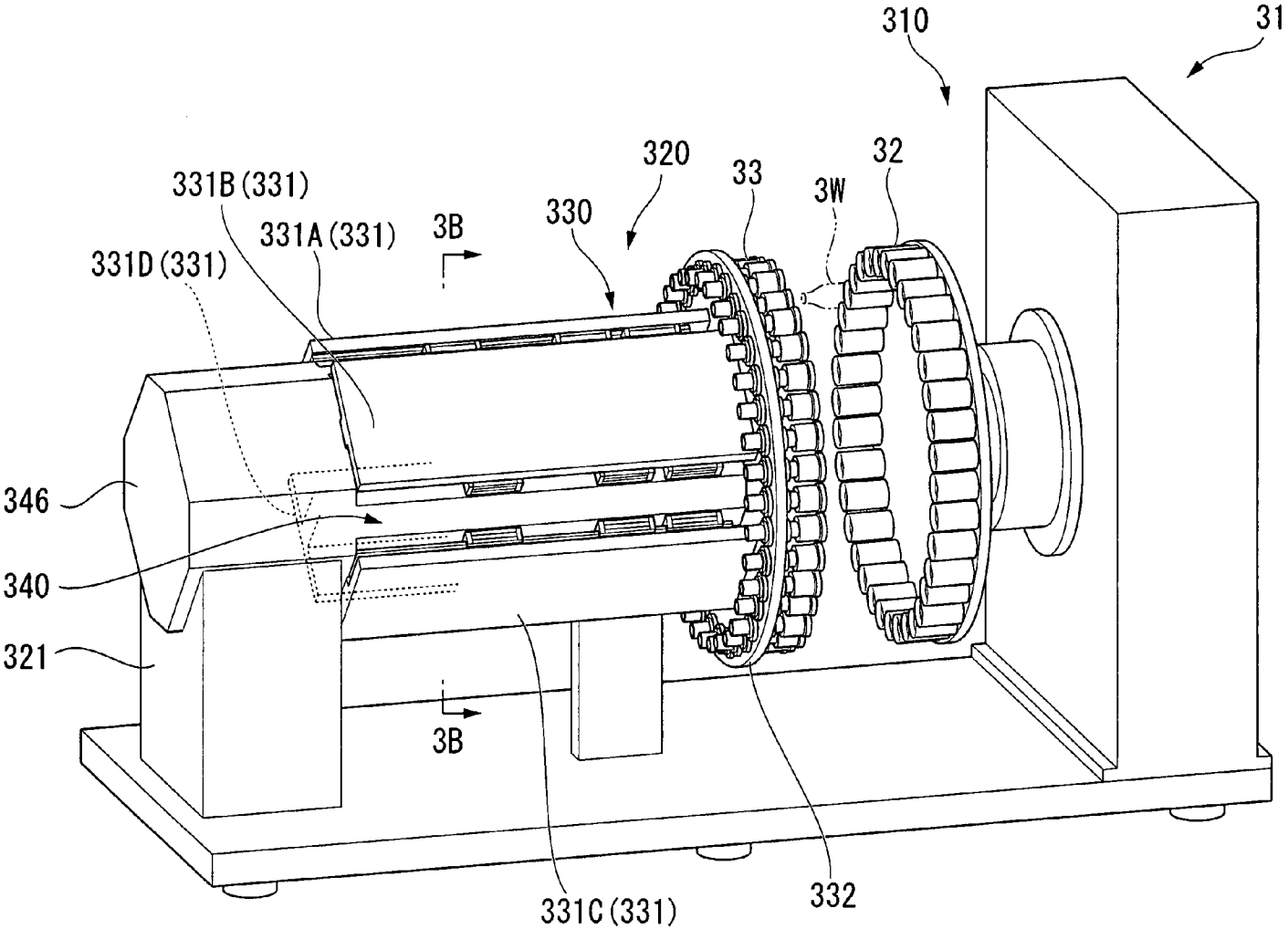
FIG. 21 is a perspective view showing a schematic configuration of a bottle can manufacturing device according to a second modified example of the third embodiment of the present invention.
Figure 22:
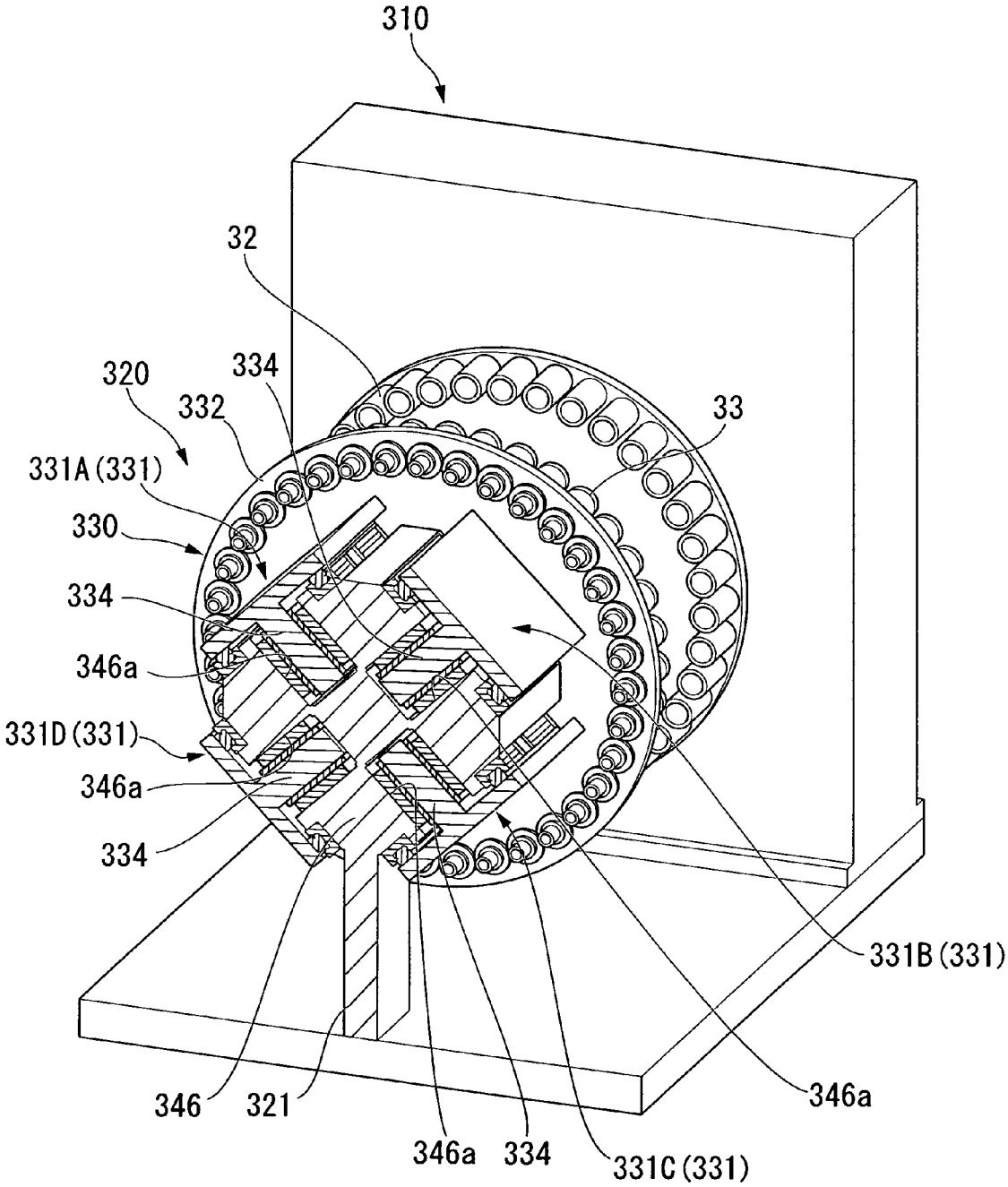
FIG. 22 is a sectional view showing a tool supporting base shown in FIG. 21, taken along the line 3B-3B.

Next, FIG. 21 is a perspective view showing a schematic configuration of a bottle can manufacturing device according to the second modified example of the third embodiment of the present invention. FIG. 22 is a sectional view showing the tool supporting base shown in FIG. 21, taken along the line 3B-3B, and FIG. 23 is a perspective view showing the tool supporting base shown in FIG. 22 with the supporting trestle thereof being omitted.

Figure 23:
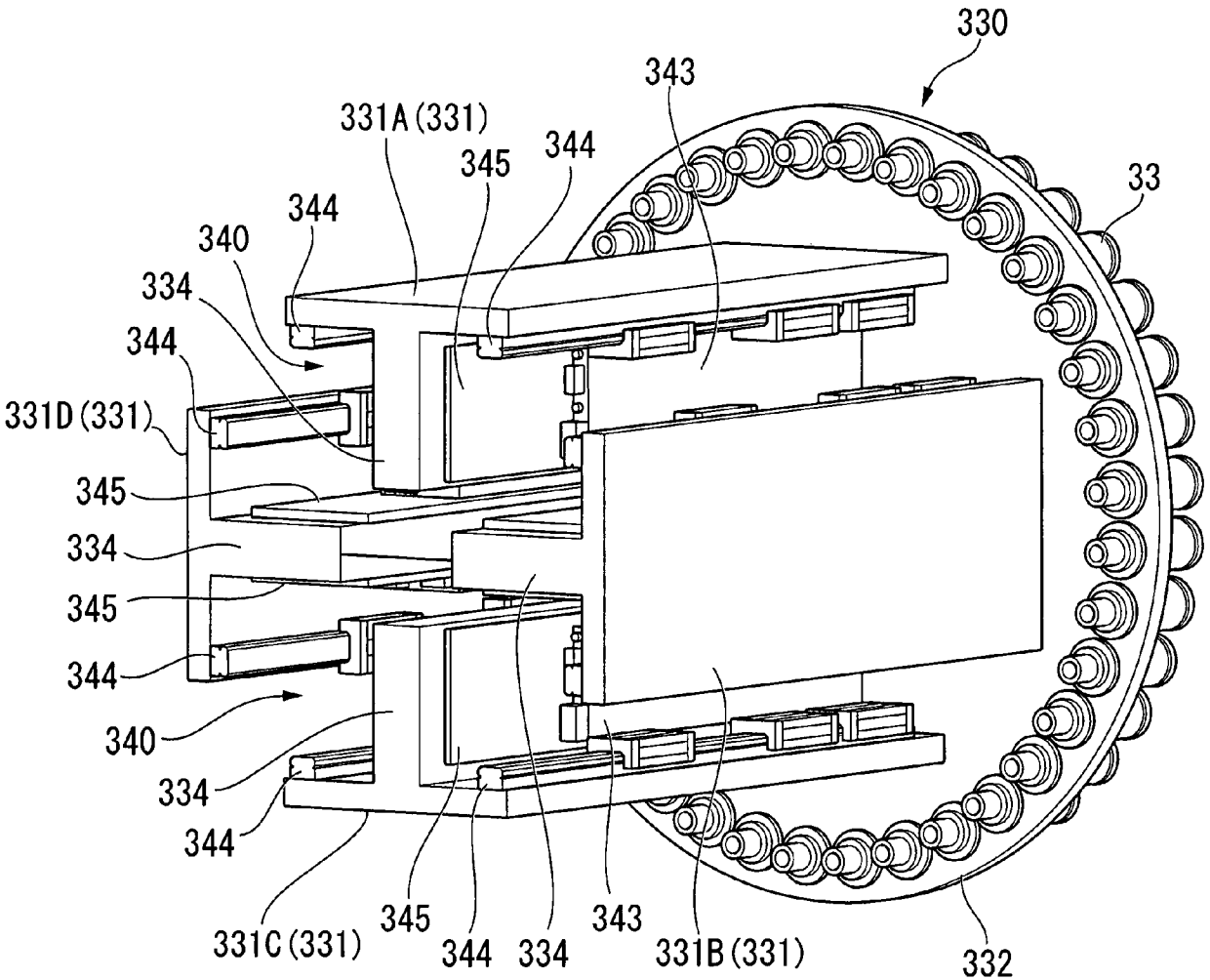
FIG. 23 is a perspective view showing the tool supporting base shown in FIG. 22, with a supporting trestle being omitted.

As shown in FIG. 21 to FIG. 23, in the present modified example, while a single T-shape base 331 is provided in the working tool unit 330 in the above third embodiment (refer to FIG. 15), a plurality of the T-shape bases 331 (331A, 331B, and 331C) are provided in the working tool unit 330 instead. Here, the configuration of the T-shape bases 331A to 331D is similar to that in the third embodiment described above, and therefore the detailed description thereof is omitted.

That is to say, on the fixed section 321, there is provided a supporting trestle 346 having four primary lines in a sectional view, and on each of four faces corresponding to the four lines, there is formed a recessed groove section 346*a*. The projecting section 334 of the T-shape base 331 slidably engages with each of these recessed groove sections 346*a*, in the axial direction of the workpiece 3W. That is to say, there is provided a configuration such that with the supporting trestle 346 being at the center when seen on the front view, four of the T-shape bases 331A to 331D are arranged therearound. The tool supporting disk 332 is supported by the four T-shape bases 331A to 331D.

In the present second modified example, as with the third embodiment described above and the first modified example thereof, there is employed the double-side type linear driving method. Therefore it is possible to reduce the size and weight of the working tool unit 330 while suppressing vibrations in reciprocation. Moreover, since the tool supporting disk 332 is supported by the four T-shape bases 331A to 331D, it is possible to employ the tool supporting disk 332 having a large outer diameter, and there is consequently achieved an effect in which the number of the working tools 33 to be arranged on the tool supporting disk 332 can be increased.

There have been described the can manufacturing device and the can manufacturing method that uses this device according to the third embodiment of the present invention and the first and second modified examples thereof. However, the present invention is not limited to the above third embodiment and the first and second modified examples thereof, and appropriate modifications may be made thereto without departing the scope of the invention.

For example, the tool supporting disk 332 is integrated in a disk shape in the present embodiment. However, this is not limited to the integrated structure, and the structure may be provided in a form of being divided in the circumferential direction. For example, in a case where there are provided a plurality of bases as with the above second modified example, the tool supporting disk 332 may be divided so as to be integrated with each of the bases. In this case, each of the divided tool supporting disks 332 can be individually driven to thereby be reciprocated in the axial direction of the workpiece 3W. Consequently, it is possible, for example, to change the reciprocation speed of each tool supporting disk 332, shift the timing of approaching and moving away from the workpiece 3W, and change the strokes to thereby change the clearance between the workpiece 3W and the working tool 33. As a result, it is possible to form bottle cans in various types of shapes.

Moreover, in the above third embodiment and the first modified example thereof, there is provided a single base (T-shape base 331 and recessed base 335), and there are provided the four T-shape bases 331A to 331D in the above second modified example. However, there may be provided two, three, five, or more bases without being limited to the number of the bases with respect to the supporting trestle 341.

Furthermore, in the present embodiment, there is provided a configuration in which one slide rail 344 is arranged on both sides of the projecting section (or recessed groove section) of the base. However, it is not limited to this, and two of them may be arranged for example.

In a case of providing a cooling mechanism in the linear driving mechanism of the above third embodiment, an electromagnetic coil is provided in the supporting trestle, and in the electromagnetic coil, there may be provided a supply pipe for supplying coolant to the inside thereof. That is to say, the electromagnetic coil 343 may be provided on the inner surface of the recessed groove section 341*a* (346*a*) formed on the supporting trestle 341 (346), and in the electromagnetic coil 343, there may be provided the supply pipe 143*a* of the above first embodiment for supplying coolant to the inside thereof.

In this case, the electromagnetic coil 343 with the supply pipe 143*a* provided therein is fixed on the supporting trestle 341 (346), and therefore the supply pipe 143*a* does not move together with reciprocation of the working tool unit 330, and it is, as a result, possible to prevent damage or breakage of the supply pipe 143.

Moreover, the above bottle can manufacturing device may be provided with: first and second workpiece supporting disks that are arranged facing each other and that are capable of intermittently rotating about the rotational axis; a plurality of workpiece holders that are provided on the outer periphery section of these workpiece supporting disks and that hold a bottom-ended cylindrical workpiece; a tool supporting base arranged between the first and second workpiece supporting disks; a base supported, via a linear driving mechanism, on the tool supporting base; and a plurality of working tools that are provided on the base and are respectively arranged facing the first and second workpiece supporting disks and that perform working on the workpieces. Moreover, the plurality of working tools may be linearly reciprocated via the base between the first and second workpiece supporting disks by the linear driving mechanism, and when performing this linear reciprocation, the plurality of working tools may be made to alternately approach and move away from the first and second workpiece supporting disks, to thereby perform working on the workpiece.

That is to say, the bottle can manufacturing device 31 may be provided with: the first and second workpiece supporting disks 313 that are arranged facing each other and that are capable of intermittently rotating about the rotational axis; a plurality of the workpiece holders 32 that are provided on the outer periphery section of these workpiece supporting disks 313 and that hold the bottom-ended cylindrical workpiece 3W; the tool supporting base 320 arranged between the first and second workpiece supporting disks 313; the base 335 supported, via the linear driving mechanism 340, on the tool supporting base 320; and a plurality of the working tools 33 that are arranged facing the first and second workpiece supporting disks 313 and that perform working on the workpieces 3W. Moreover, the plurality of the working tools 33 may be linearly reciprocated via the base 335 between the first and second workpiece supporting disks 313 by the linear driving mechanism 340, and when performing this linear reciprocation, the plurality of working tools 33 may be made to alternately approach and move away from the first and second workpiece supporting disks 313, to thereby perform working on the workpiece.

In this case, compared to the conventional bottle can manufacturing device, it is possible to significantly improve production efficiency.

INDUSTRIAL APPLICABILITY

It is possible to provide a can manufacturing device in which the weight thereof can be reduced by reducing the size of members, while preventing damage or breakage of the supply pipe for supplying coolant to the electromagnetic coil.

Moreover, it is possible to provide a can manufacturing device and a can manufacturing method in which the configuration of the driving mechanism is simplified and shape-formation of cans can be performed at an excellent level of precision over a prolonged period of time, while a single stroke time can be reduced and production efficiency can be significantly improved.

Furthermore, it is possible to provide a can manufacturing device and a can manufacturing method that uses this device, in which vibrations in the working tool unit are suppressed and thereby precision of workings performed on cans is improved.

The invention claimed is:

1. A can manufacturing device provided with:

a workpiece supporting base that supports, on a circumference thereof, a plurality of bottom-ended cylindrical workpieces having an axis; and a tool supporting base that supports a plurality of working tools for performing working on the workpieces and that is arranged facing the workpiece supporting base in the axial direction of the workpiece, in which the plurality of working tools are made to approach and move away from the workpiece supporting base in the axial direction of the workpieces, to thereby perform working on the workpieces supported on the workpiece supporting base, wherein the tool supporting base is provided with:

a plurality of working tool units that support the plurality of working tools;

a supporting member that supports the plurality of working tool units; and a linear driving mechanism that reciprocates the working tool units with respect to the supporting member in the axial direction of the workpiece, and the linear driving mechanism is provided with:

a guide section that is fixed on the supporting member with a base plate therebetween;

a slide rail that is fixed on the working tool unit and that slides along the guide section;

an electromagnetic coil provided on the base plate;

a magnet plate that is provided on the working tool unit and that generates, between the electromagnetic coil and itself, a thrust force for the guide section; and a supply pipe that is provided at the electromagnetic coil and that supplies coolant to the inside of the electromagnetic coil.

2. The can manufacturing device according to claim 1, wherein the base plate is provided with an engaging member that engages with the slide rail to thereby stop the working tool unit.

3. The can manufacturing device according to claim 1, wherein the working tool unit is provided with a base that is of a flat plate shape and that has the slide rail fixed on a back face of the base, and a tool holding section that is vertically provided on an edge of a surface of the base, the surface facing the workpiece supporting base, and that holds the working tool, and the base and the tool holding section are arranged substantially in a L shape from a side view.

4. The can manufacturing device according to claim 1, wherein the base plate is provided with a stopper that regulates a reciprocation terminus of the working tool.

5. A bottle can manufacturing device provided with:

first and second turntables that are arranged facing each other and that are capable of intermittently rotating about a rotational axis;

a plurality of chuck units that are provided on an outer periphery section of the turntables and that hold a bottom-ended cylindrical workpiece;

a linear motor frame arranged between the first and second turntables;

a tool supporting body supported on the linear motor frame with a linear motor therebetween; and a plurality of working tools that are provided on the tool supporting body and are respectively arranged facing the first and second turntables and that perform working on the workpieces, wherein the plurality of working tools are linearly reciprocated, via the tool supporting base, between the first and second turntables by the linear motor, and when performing the linear reciprocation, the plurality of working tools are made to alternately approach and move away from the first and second turntables, to thereby perform working on the workpiece.

6. The can manufacturing device according to claim 5, wherein:

the tool supporting body is further provided with first and second die tables that are arranged facing the first and second turntables in the rotational axial direction, respectively and that each support the plurality of working tools; and the first and second die tables are driven by the linear motor.

7. The can manufacturing device according to claim 5, wherein:

the tool supporting body is further provided with a plurality of die units that each support at least one of the plurality of working tools;

the linear motor is provided at each of the die units; and the die units are driven by the respective linear motors to be thereby made to approach and move away from the first and second turntables.

8. A can manufacturing device provided with:

first and second working tools that are arranged facing each other and that perform working on bottom-ended cylindrical workpieces;

a linear motor frame arranged between the first and second working tools;

a turntable supporting body supported, via a linear motor, by the linear motor frame;

first and second turntables that are provided on the turntable supporting body and are arranged facing the first and second working tools, respectively, and that are capable of intermittently rotating about the rotational axis; and a plurality of chuck units that are provided on the outer periphery of the turntables and that hold the work, wherein the first and second turntables, via the turntable supporting body, are linearly reciprocated between the first and second working tools by the linear motor, and when performing the linear reciprocation, the first and second turntables are made to alternately approach and move away from the first and second working tools, respectively, to thereby perform working on the workpieces.

9. A can manufacturing method that uses the can manufacturing device according to claim 5, wherein:

arranging the workpiece at each of the plurality of chucks to hold the workpiece;

linearly reciprocating the plurality of working tools, via the tool supporting body, between the first and second turntables by the linear motor; and moving the plurality of working tools alternately closer to and away from the first and second turntables when performing the linear reciprocation, to thereby perform working on the workpiece.

10. A can manufacturing method that uses the can manufacturing device according to claim 8, wherein:

arranging the workpiece at each of the plurality of chucks to hold the workpiece;

linearly reciprocating the first and second turntables, via the turntable supporting body, between the first and second working tools by the linear motor; and moving the first and second turntables alternately closer to and away from the first and second working tools when performing the linear reciprocation, to thereby perform working on the workpiece.

11. A can manufacturing device provided with:

a workpiece supporting base that supports, on a circumference thereof, a plurality of bottom-ended cylindrical workpieces having an axis; and a tool supporting base that supports a plurality of working tools for performing working on the workpieces and that is arranged facing the workpiece supporting base in the axial direction of the workpiece, in which the plurality of working tools are made to approach and move away from the workpiece supporting base in the axial direction of the workpieces, to thereby perform working on the workpieces supported on the workpiece supporting base, wherein the tool supporting base is provided with:

a working tool unit that is made to approach and move away from the workpiece supporting base in the axial direction; and a supporting trestle that supports the working tool unit so as to be able to move in the axial direction, the working tool unit is provided with:

a base that moves along the axial direction; and a tool supporting disk that is fixed on the workpiece supporting base side of the base and that has the working tool arranged thereon in the circumferential direction thereof, the base is provided with:

a projecting section that extends along the axial direction; and a magnet plate provided on the outer side surface of the projecting section, the supporting trestle is provided with:

a recessed groove section that engages with the projecting section so as to be able to relatively move in the axial direction; and an electromagnetic coil provided on the inner side surface of the recessed groove section, and wherein in a state where the projecting section is engaged with the recessed groove section, the electromagnetic coil and the magnet plate generate a thrust force to move the working tool unit in the axial direction.

12. A can manufacturing device provided with:

a workpiece supporting base that supports, on the circumference thereof, a plurality of bottom-ended cylindrical workpieces having an axis; and a tool supporting base that supports a plurality of working tools for performing working on the workpieces and that is arranged facing the workpiece supporting base in the axial direction of the workpiece, in which the plurality of working tools are made to approach and move away from the workpiece supporting base in the axial direction of the workpieces, to thereby perform working on the workpieces supported on the workpiece supporting base, wherein the tool supporting base is provided with:

a working tool unit that is made to approach and move away from the workpiece supporting base in the axial direction; and a supporting trestle that supports the working tool unit so as to be able to move in the axial direction, the working tool unit is provided with:

a base that moves along the axial direction; and a tool supporting disk that is fixed on the workpiece supporting base side of the base and that has the working tool arranged thereon in the circumferential direction thereof, the base is provided with:

a recessed groove section that extends along the axial direction; and a magnet plate provided on the inner side surface of the recessed groove section, the supporting trestle is provided with:

a projecting section that engages with the recessed groove section so as to be able to relatively move in the axial direction; and an electromagnetic coil provided on the outer side surface of the projecting section, and wherein in a state where the recessed groove section is engaged with the projecting section, the magnet plate and the electromagnetic coil generate a thrust force to move the working tool unit in the axial direction.

13. The can manufacturing device according to claim 11, wherein the working tool unit is arranged on an outer side or an upper side of the supporting trestle.

14. The can manufacturing device according to claim 11, wherein the base is provided in plural numbers.

15. A can manufacturing method that uses the can manufacturing device according to claim 11, wherein:

the workpiece supporting base supports the workpiece; and the plurality of working tools are made to approach and move away from the workpiece supporting base in the axial direction of the workpiece, to thereby perform working on the workpiece supported on the workpiece supporting base.

16. The can manufacturing device according to claim 12, wherein the working tool unit is arranged on an outer side or an upper side of the supporting trestle.

17. The can manufacturing device according to claim 12, wherein the base is provided in plural numbers.

18. A can manufacturing method that uses the can manufacturing device according to claim 12, wherein:

the workpiece supporting base supports the workpiece; and the plurality of working tools are made to approach and move away from the workpiece supporting base in the axial direction of the workpiece, to thereby perform working on the workpiece supported on the workpiece supporting base.

* * * * *